US009889665B2

(12) United States Patent
Ogawa

(10) Patent No.: US 9,889,665 B2
(45) Date of Patent: Feb. 13, 2018

(54) LIQUID DISCHARGING DEVICE

(71) Applicant: BROTHER KOGYO KABUSHIKI KAISHA, Nagoya, Aichi (JP)

(72) Inventor: Mikio Ogawa, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 0 days.

(21) Appl. No.: 15/281,294

(22) Filed: Sep. 30, 2016

(65) Prior Publication Data

US 2017/0087845 A1 Mar. 30, 2017

(30) Foreign Application Priority Data

Sep. 30, 2015 (JP) ..... 2015-195360

(51) Int. Cl.
*B41J 2/165* (2006.01)

(52) U.S. Cl.
CPC ..... *B41J 2/16505* (2013.01); *B41J 2/16547* (2013.01); *B41J 2002/16594* (2013.01)

(58) Field of Classification Search
CPC ... B41J 23/00; B41J 23/02; B41J 29/00; B41J 29/02; B41J 2/165; B41J 2/16505; B41J 2/16547; B41J 2/16517; B41J 2002/16594
See application file for complete search history.

(56) References Cited

U.S. PATENT DOCUMENTS 5,841,450 A 11/1998 Kawamura
2002/0126177 A1* 9/2002 Sugimura ..... B41J 23/025 347/29
2007/0048058 A1 3/2007 Koga et al.
2007/0048059 A1 3/2007 Asada et al.
2007/0057447 A1 3/2007 Asada et al.
2007/0076036 A1 4/2007 Koga et al.
2007/0231044 A1 10/2007 Koga et al.
2009/0035018 A1 2/2009 Koga et al.
2009/0035019 A1 2/2009 Koga et al.
2009/0256874 A1 10/2009 Samoto et al.
2011/0074874 A1 3/2011 Ogawa

FOREIGN PATENT DOCUMENTS

JP H05-24278 A 2/1993
JP H08-174958 A 7/1996
JP 2002-254677 A 9/2002
(Continued)

*Primary Examiner* — Sharon A Polk

(74) *Attorney, Agent, or Firm* — Scully, Scott, Murphy & Presser, P.C.

(57) ABSTRACT

A liquid discharging device having a liquid discharging head with nozzles and a liquid discharging surface; a conveyer to convey a medium in a conveying direction; a nozzle cap movable to contact or to be separated from the nozzles; a pump; a switcher to switch connection and disconnection between the nozzle cap and the pump; a drivable device; a first motor connected to the conveyer to transmit a driving force; a second motor to drive the switcher and the drivable device; a selector to switch transmission destinations for a driving force form the second motor between the switcher and the drivable device depending on a rotating direction of the second motor; and a controller to control the second motor to rotate in one of a first direction and a second direction opposite from the first direction, is provided.

29 Claims, 17 Drawing Sheets

(56) References Cited

FOREIGN PATENT DOCUMENTS

| | | | |
|---|---|---|---|
| JP | 2003-89244 | A | 3/2003 |
| JP | 2007-090761 | A | 4/2007 |
| JP | 2007-090800 | A | 4/2007 |
| JP | 4582183 | B2 | 11/2010 |
| JP | 2011-136436 | A | 7/2011 |
| JP | 5062202 | B2 | 10/2012 |
| JP | 5187293 | B2 | 4/2013 |
| JP | 2014-000827 | A | 1/2014 |
| JP | 2014-000827 | A | 9/2014 |

* cited by examiner

CONVEYING DIRECTION

LIQUID DISCHARGING DEVICE

CROSS REFERENCE TO RELATED APPLICATION

This application claims priority under 35 U.S.C. § 119 from Japanese Patent Application No. 2015-195360, filed on Sep. 30, 2015, the entire subject matter of which is incorporated herein by reference.

BACKGROUND

Technical Field

The following description relates to one or more aspects of a liquid discharging device capable of discharging liquid through nozzles.

Related Art

A liquid discharging device capable of discharging liquid through nozzles, e.g., a multifunction peripheral (MFP) having an inkjet printer to print an image in ink that is discharged through nozzles at a sheet, is known. The inkjet printer may have an inkjet head with the nozzles, a cap to cover the nozzles, and a pump, which may be connected with a port-switchable device having a switchable member. The switchable member and the pump may be activated by a conveyer motor, which may be provided to rotate conveyer rollers in the inkjet printer. For example, a driving force from the conveyer motor rotating in one direction may be transmitted to the pump, and a driving force from the conveyer motor rotating in an opposite direction may be transmitted to the port-switchable device so that activation of the pump and the port-switchable device may be switched depending on the rotating direction of the conveyer motor.

SUMMARY

While the conveyer motor to drive the port-switchable device may rotate the conveyer rollers, in order to drive the conveyer rollers, the conveyer motor may be required to provide a certain extent of intensity of torque. Therefore, in order to rotate the conveyer rollers and drive the port-switchable device simultaneously, it may be necessary that the port-switchable device is designed to be drivable by smaller torque. Meanwhile, when ink in the port-switchable device is thickened, and viscosity of the ink increases, the port-switchable device may not be drivable by the smaller torque. In order to increase the torque to the port-switchable device, a reduction rate in gears between the conveyer motor and the port-switchable device may be increased. However, with the increased reduction ratio in the gears, switching motions to switch connections between the cap and the pump may require longer time.

Aspects of the present disclosure are advantageous in that a liquid discharging device capable of providing greater driving torque in a switchable device without increasing a size of the motor or increasing a reduction ratio in gears, is provided.

According to an aspect of the present disclosure, a liquid discharging device is provided. The liquid discharging device includes a liquid discharging head having a plurality of nozzles and a liquid discharging surface, the plurality of nozzles being formed on the liquid discharging surface; a conveyer configured to convey a medium in a conveying direction, the conveying direction extending at least partly in parallel with the liquid discharging surface; a nozzle cap configured to move between a contacting position to contact the liquid discharging head and a separated position separated from the liquid discharging head, the nozzle cap being configured to cover the plurality of nozzles when contacting the liquid discharging head; a pump; a switcher configured to switch connection and disconnection between the nozzle cap and the pump; a drivable device; a first motor connected to the conveyer, the first motor being configured to transmit a driving force thereof to the conveyer to drive the conveyer; a second motor configured to drive the switcher and the drivable device; a selector configured to switch transmission destinations for a driving force from the second motor between the switcher and the drivable device to selectively transmit the driving force from the second motor to one of the switcher and the drivable device, the selector switching the transmission destinations depending on a rotating direction of the second motor; and a controller configured to control the second motor to rotate in one of a first direction and a second direction opposite from the first direction, the controller manipulating the selector to switch the transmission destination to the switcher to transmit the driving force from the second motor to the switcher by rotating the second motor in the first direction, and the controller manipulating the selector to switch the transmission destination to the drivable device by rotating the second motor in the second direction.

BRIEF DESCRIPTION OF THE ACCOMPANYING DRAWINGS

Figure 6A:
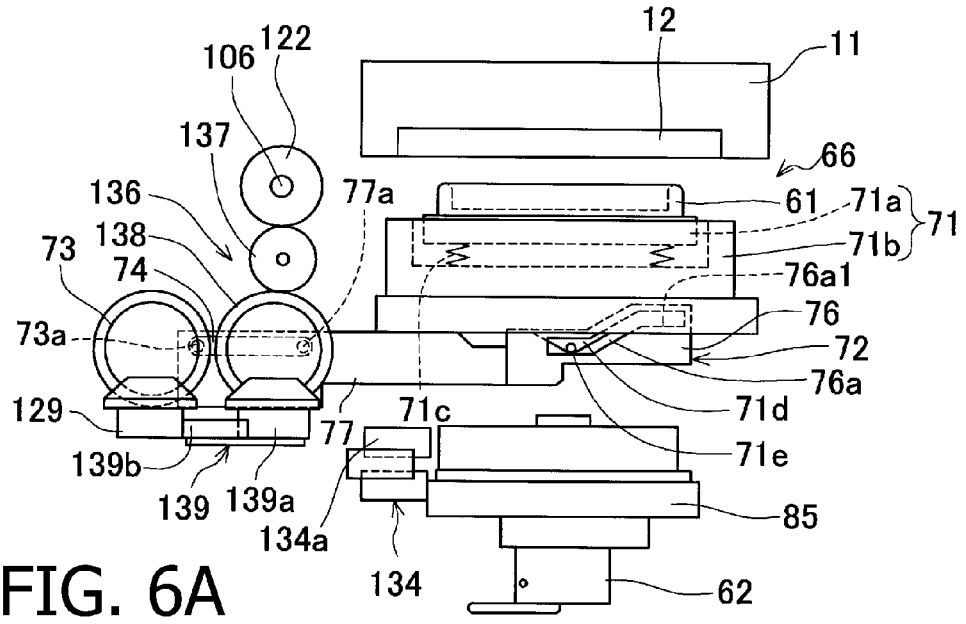
Figure 6B:
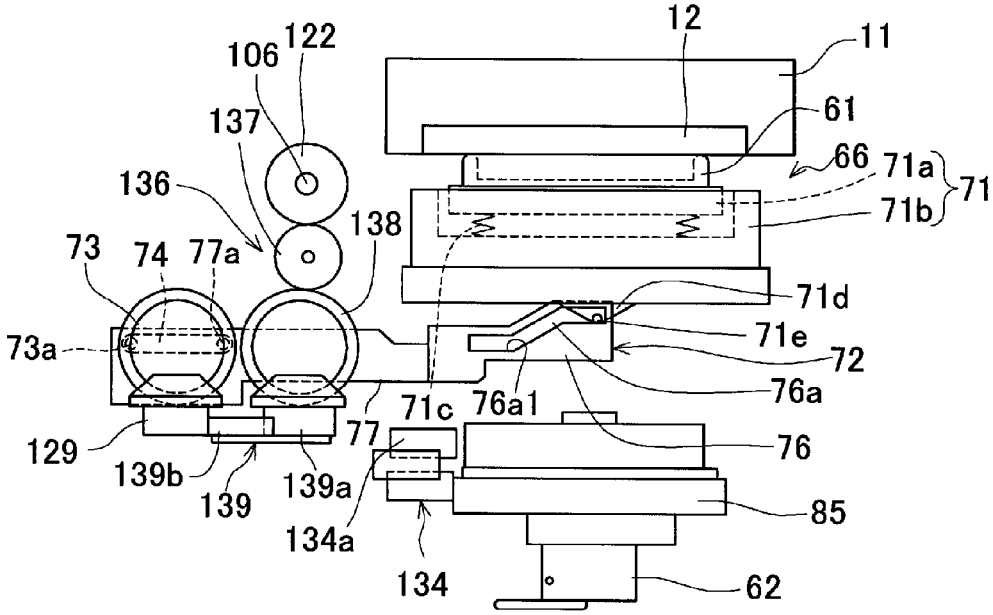

FIG. 6A is a leftward side view of the cap-lifting device, the switcher valve, and the gears with a nozzle cap being lowered to a separated position in the printer according to the embodiment of the present disclosure. FIG. 6B is a leftward side view of the cap-lifting device, the switcher valve, and the gears with the nozzle cap being uplifted to a contacting position in the printer according to the embodiment of the present disclosure.

Figure 7:
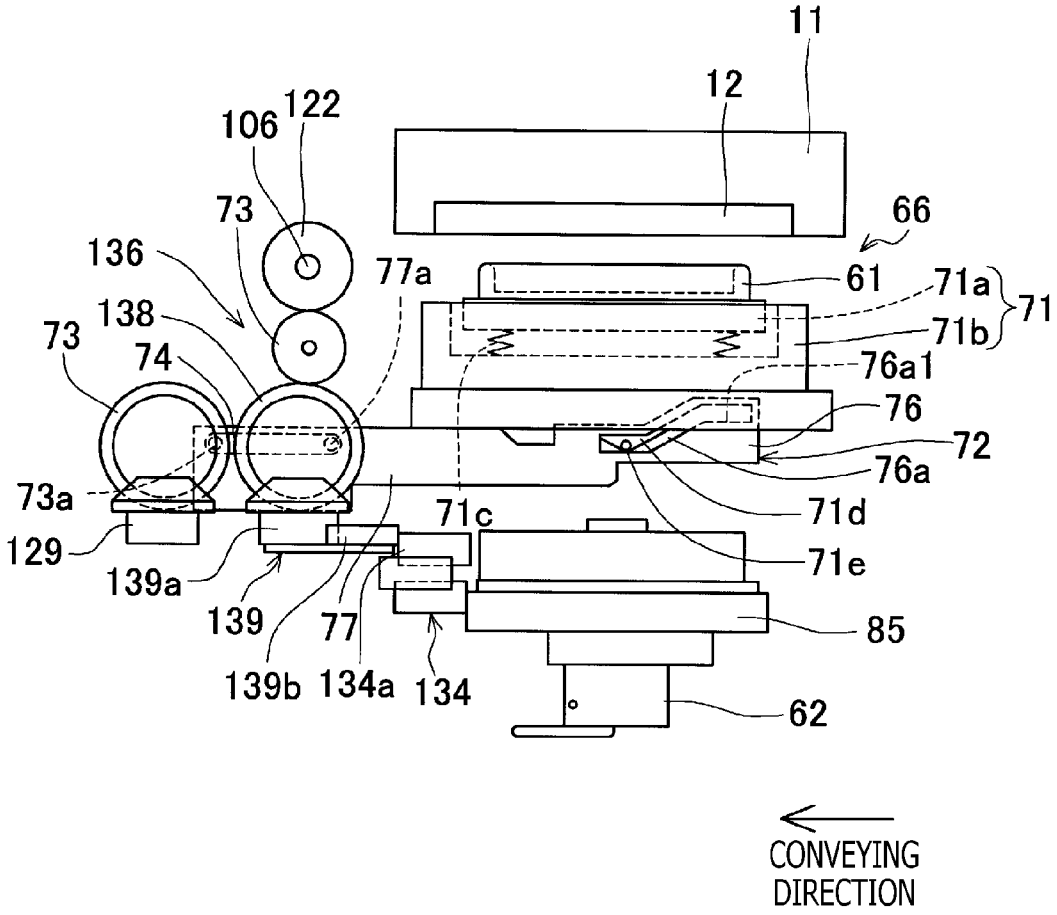

FIG. 7 is a leftward side view of the cap-lifting device, the switcher valve, and the gears with the switcher valve being driven in the printer according to the embodiment of the present disclosure.

Figure 8:
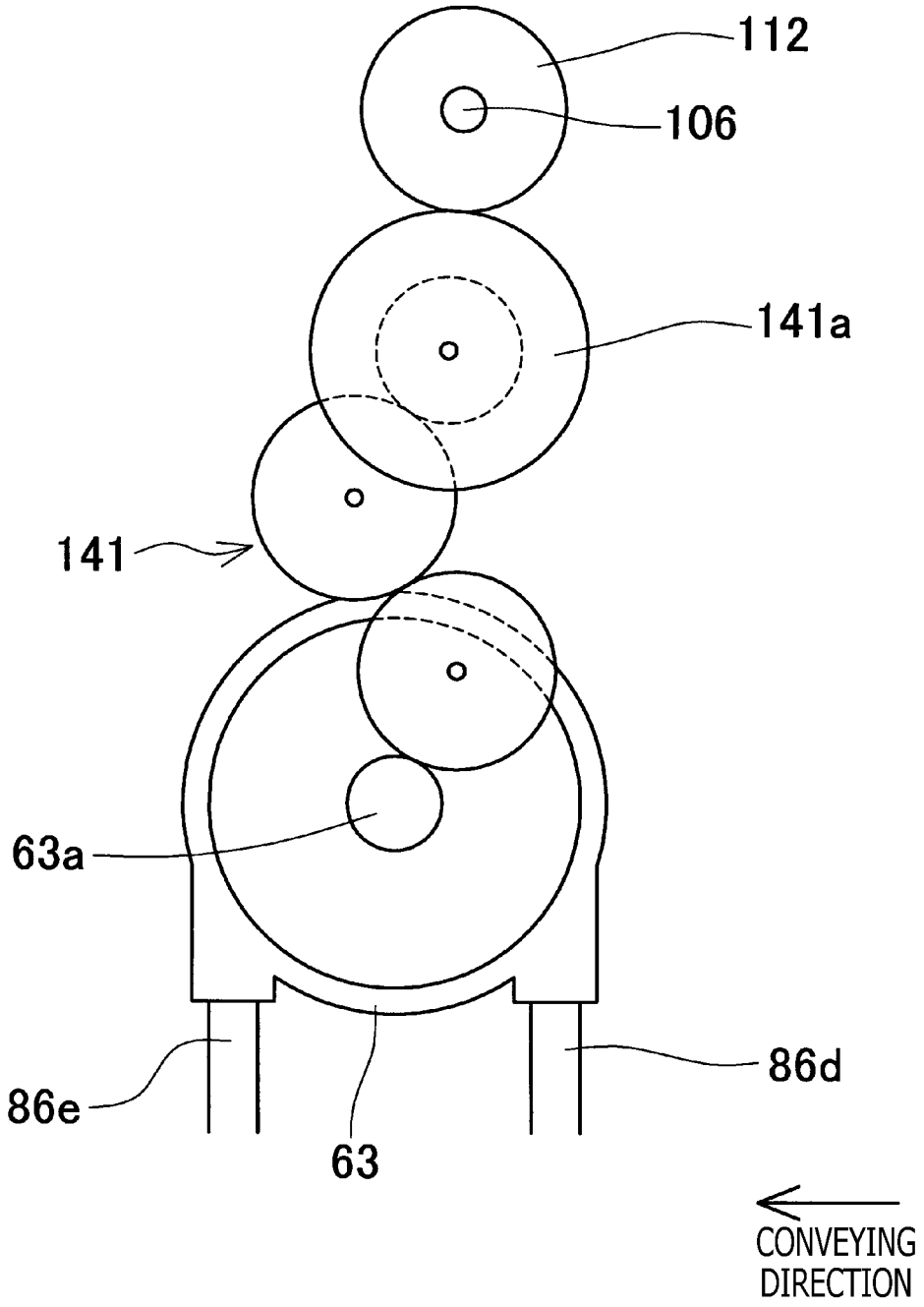

FIG. 8 is a leftward side view to illustrate an arrangement of an aspirator pump and gears connected thereto in the printer according to the embodiment of the present disclosure.

Figure 9A:
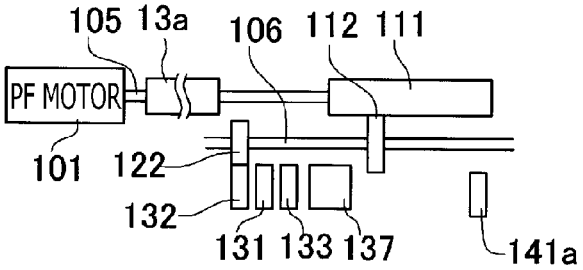
Figure 9B:
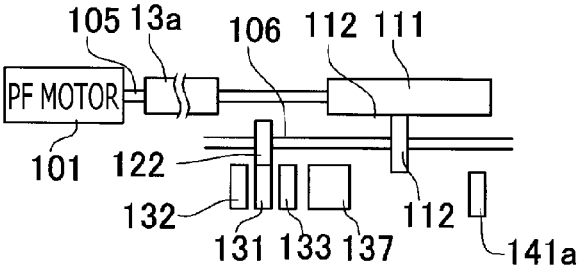
Figure 9C:
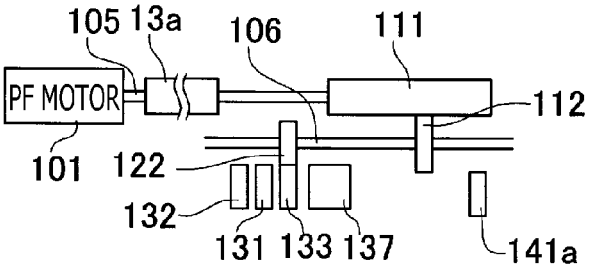
Figure 9D:
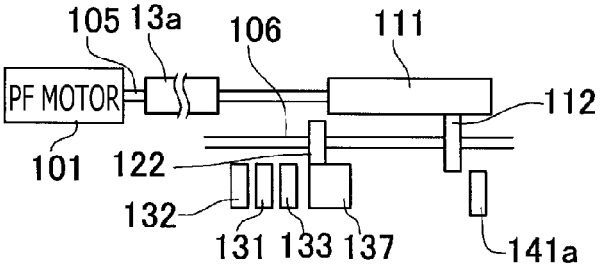
Figure 9E:
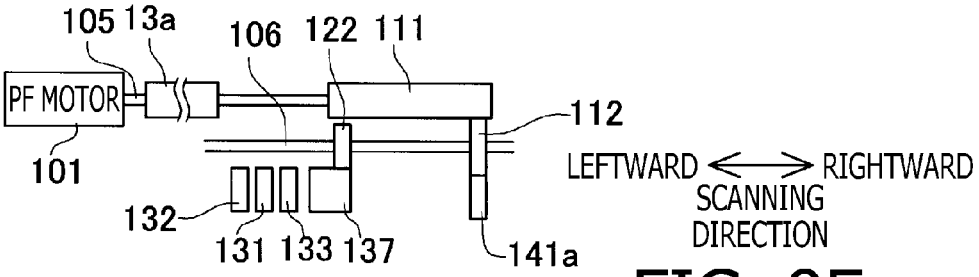

FIGS. 9A-9E are illustrative views to show interconnection among a paper-feed (PF) motor, a feeder roller, a PF input gear, and a PF switchable gear in the printer according to the embodiment of the present disclosure, with an auto sheet-feeder (ASF) switchable gear being engaged with an upper feeder gear (FIG. 9A); with the ASF switchable gear being engaged with a lower feeder gear (FIG. 9B); with the ASF switchable gear being engaged with a tray-feeder gear (FIG. 9C); with the PF switchable gear being released from a pump-drivable gear and the ASF switchable gear being engaged with a selector-drivable gear (FIG. 9D); and with the PF switchable gear being engaged with the pump-drivable gear and the ASF gear being engaged with the selector-drivable gear (FIG. 9E).

Figure 10A:
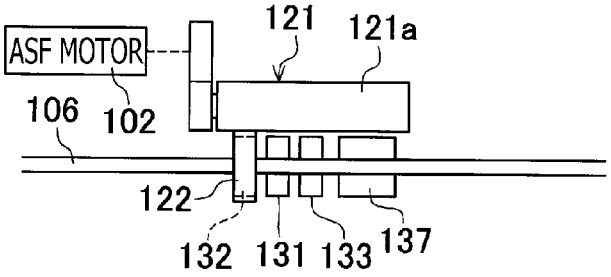
Figure 10B:
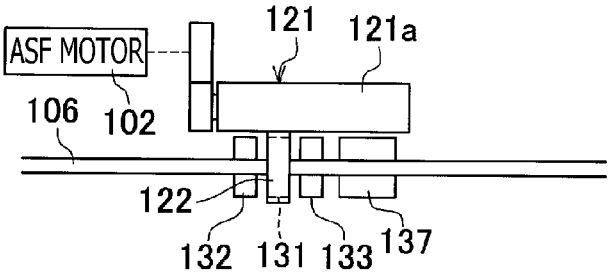
Figure 10C:
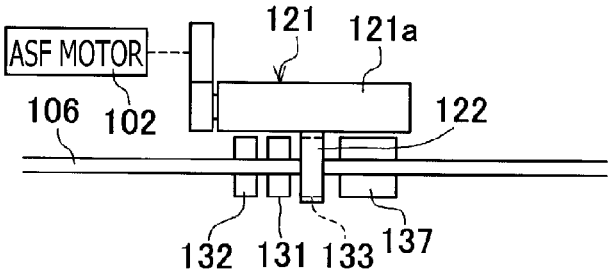
Figure 10D:
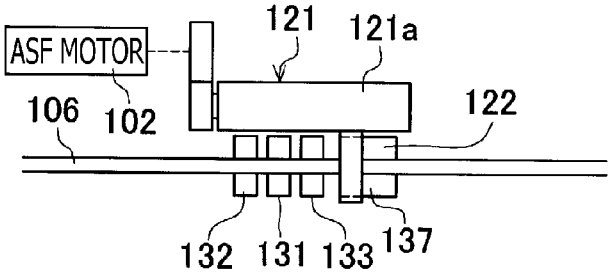
Figure 10E:
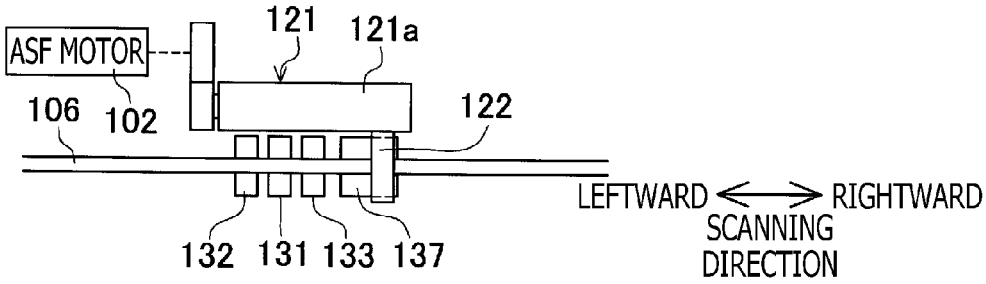

FIGS. 10A-10E are illustrative views to show interconnection among an ASF motor, an ASF input gear, and the ASF switchable gear, and connection with the upper feeder gear, the lower feeder gear, the tray-feeder gear, and the selector-drivable gear established through the ASF switchable gear in the printer according to the embodiment of the present disclosure, with the ASF switchable gear being engaged with the upper feeder gear (FIG. 10A); with the ASF switchable gear being engaged with the lower feeder gear (FIG. 10B); with the ASF switchable gear being engaged with the tray-feeder gear (FIG. 10C); with the ASF switchable gear being engaged with the selector-drivable gear (FIG. 10D); and with the ASF gear being engaged with the selector-drivable gear (FIG. 10E).

Figure 11:
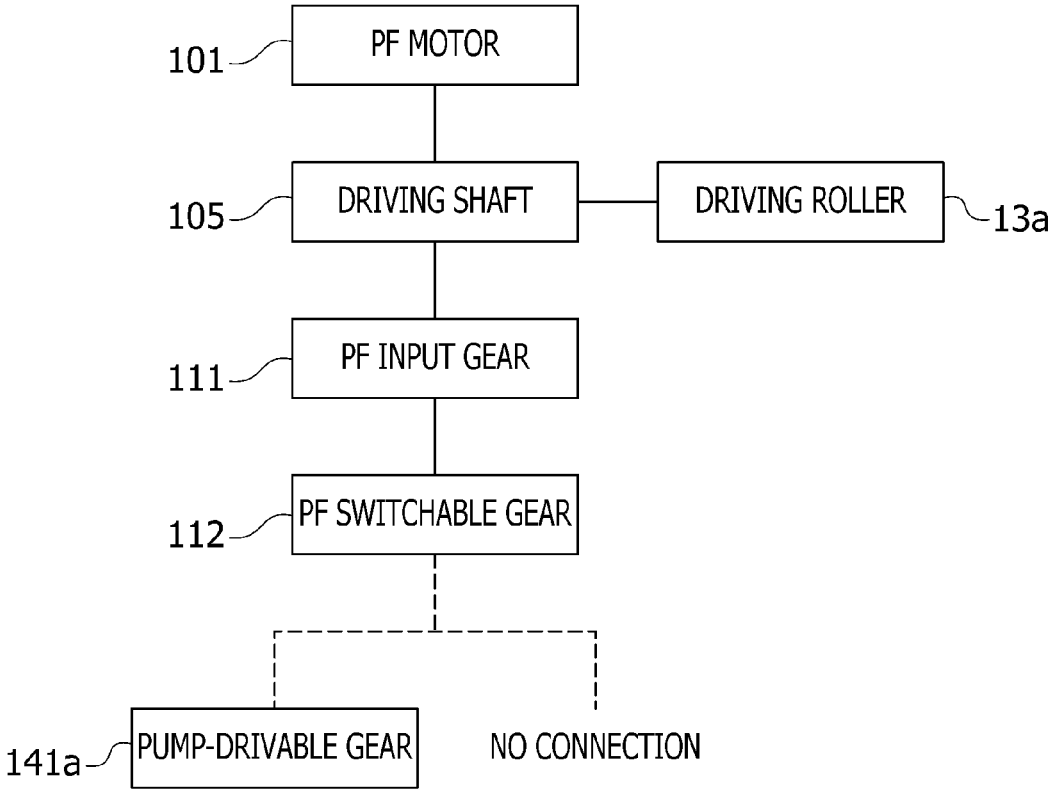

FIG. 11 is a block diagram to illustrate transmission paths from a PF motor in the printer according to the embodiment of the present disclosure.

Figure 12:
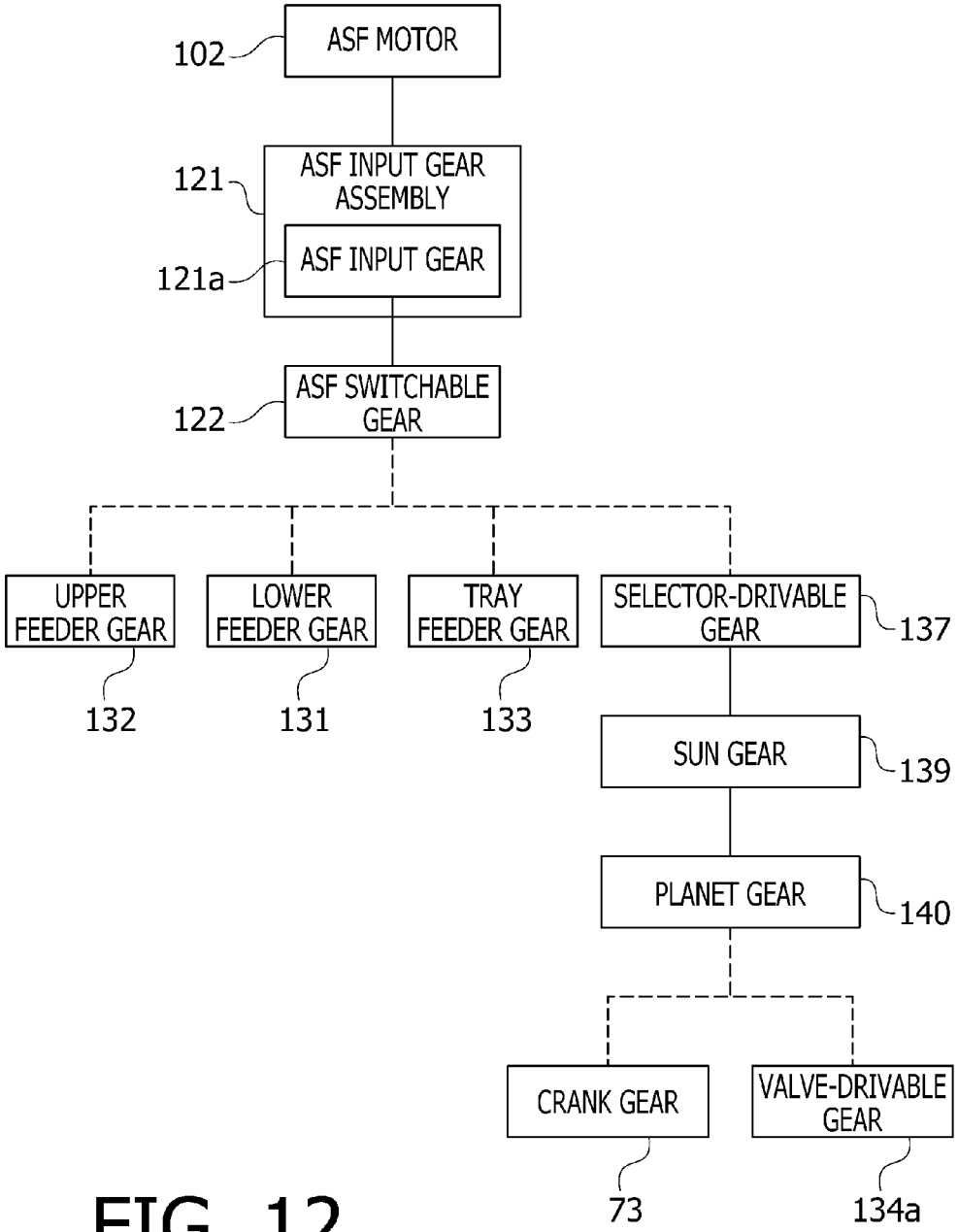

FIG. 12 is a block diagram to illustrate transmission paths from the ASF motor in the printer according to the embodiment of the present disclosure.

Figure 13:
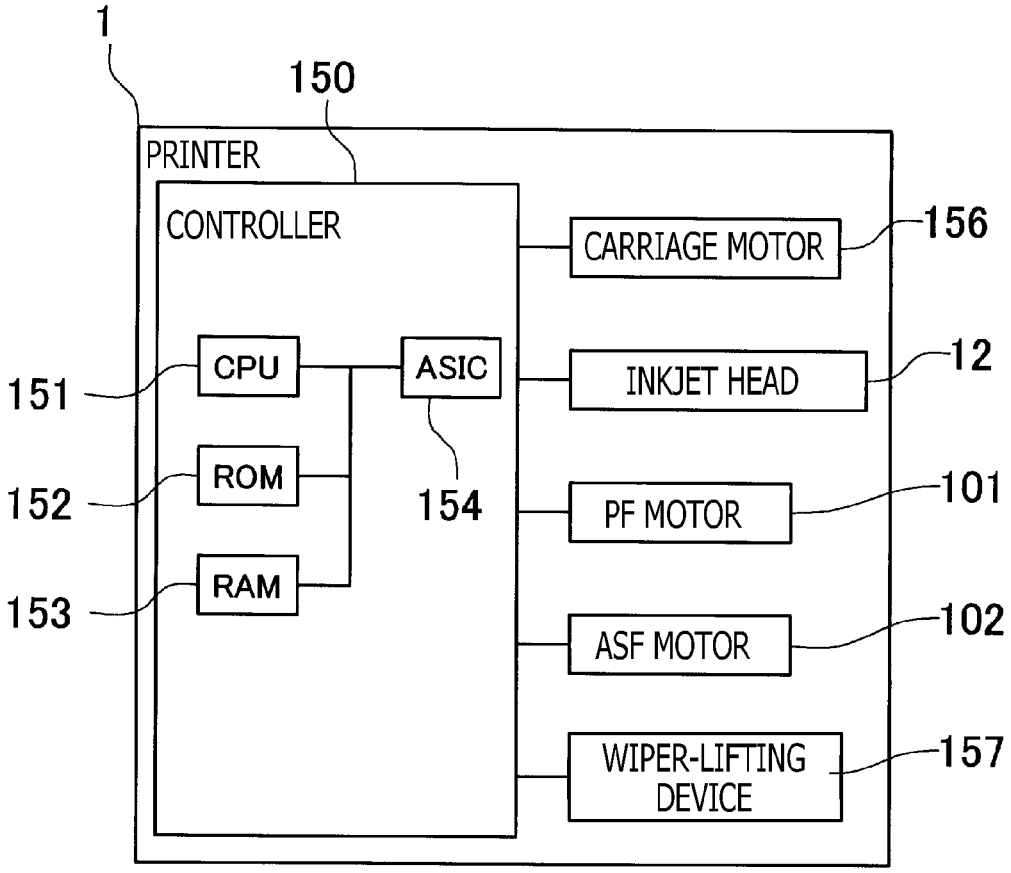

FIG. 13 is a block diagram to illustrate an electrical configuration in the printer according to the embodiment of the present disclosure.

Figure 14:
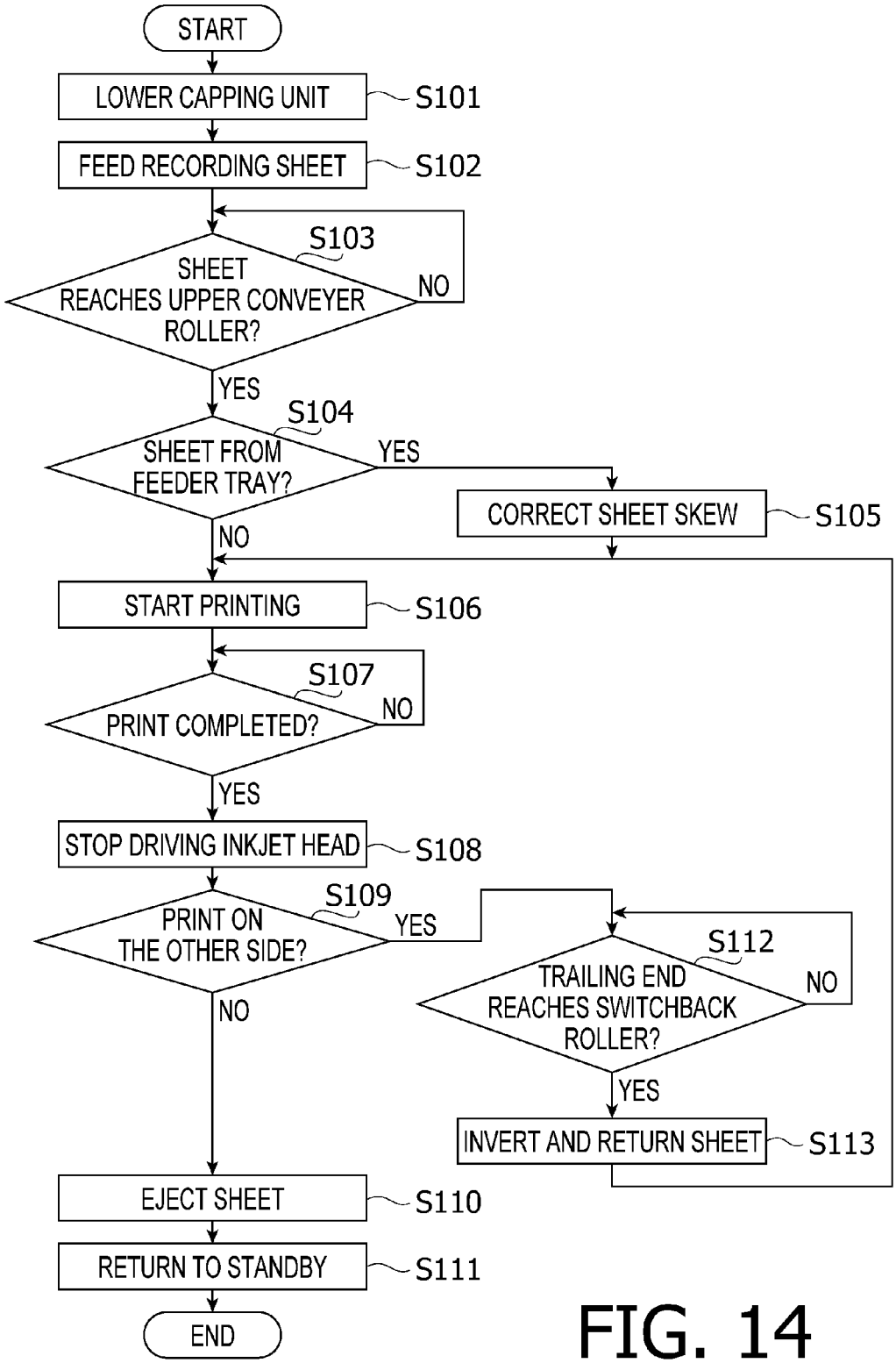

FIG. 14 is a flowchart to illustrate a flow of steps in a printing operation to be conducted by a controller in the printer according to the embodiment of the present disclosure.

Figure 15A:
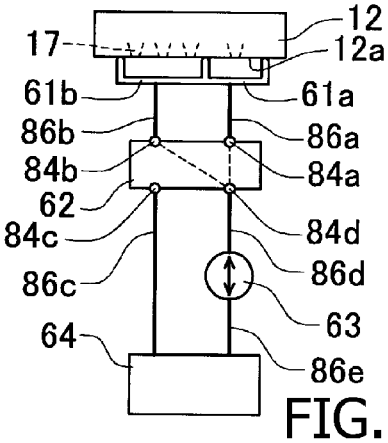
Figure 15B:
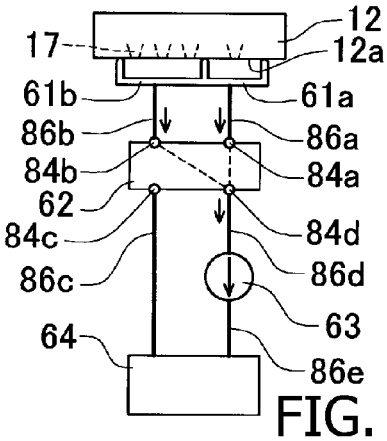
Figure 15C:
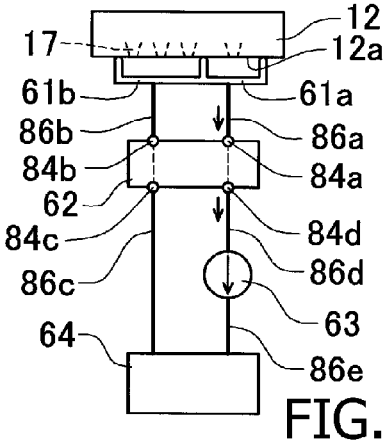
Figure 15D:
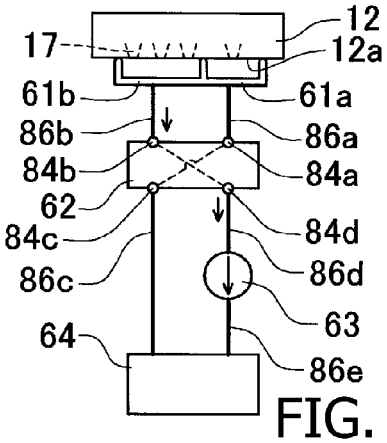
Figure 15E:
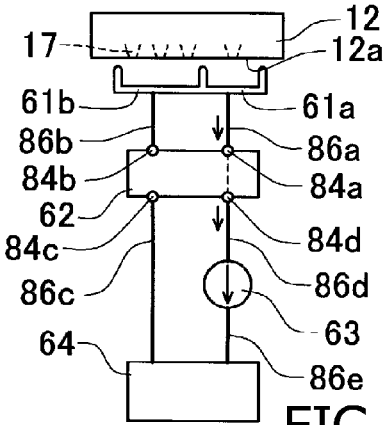
Figure 15F:
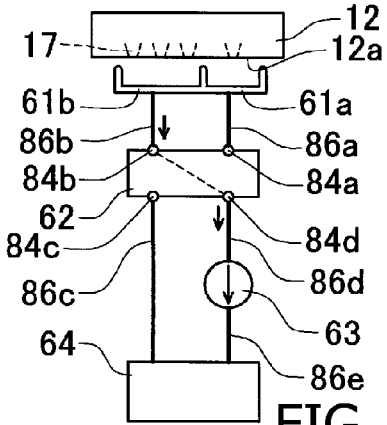

FIGS. 15A-15F are illustrative views to show communication among the nozzle cap, the switcher valve, and the aspirator pump in the inkjet printer according to the embodiment of the present disclosure, with the nozzle cap, the switcher valve, and the aspirator pump being in a standby state (FIG. 15A); in a valve-cleaning action (FIG. 15B); in an aspiration-purging action for black (FIG. 15C); in an aspiration-purging action for colors (FIG. 15D); in an idle-purging action for black (FIG. 15E); and in an idle-purging action for colors (FIG. 15F).

Figure 16:
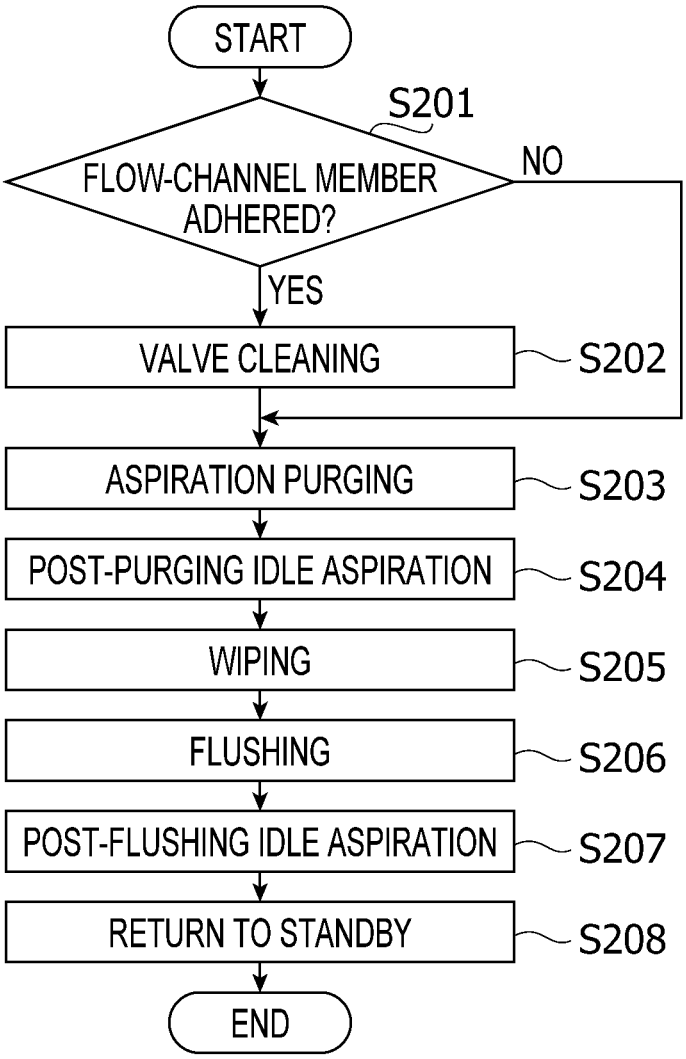

FIG. 16 is a flowchart to illustrate a flow of steps in a maintenance operation to be conducted by the controller in the printer according to the embodiment of the present disclosure.

Figure 17:
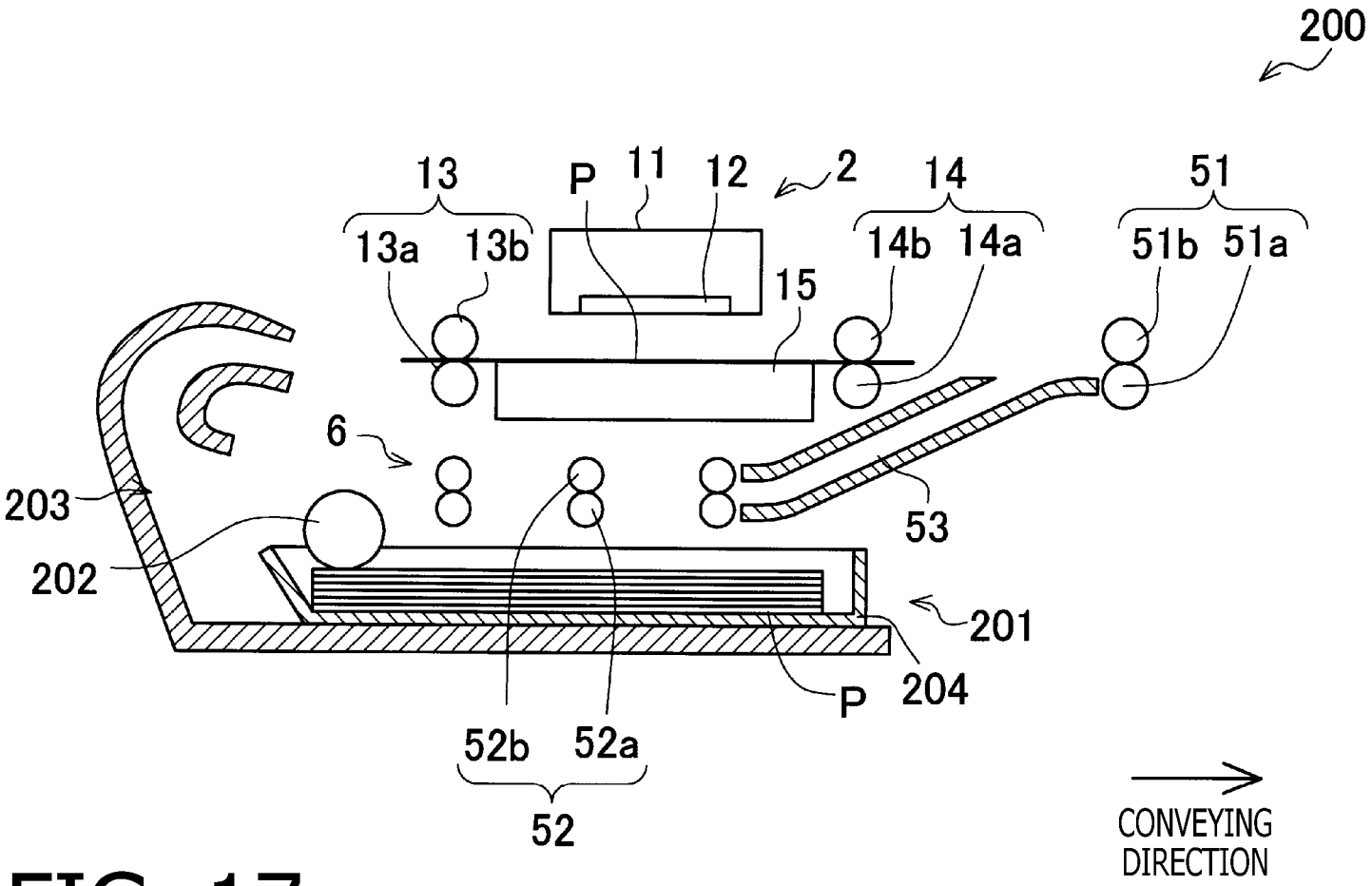

FIG. 17 is a modified example of a printer in a cross-sectional view according to another exemplary embodiment of the present invention.

DETAILED DESCRIPTION

Hereinafter, embodiments according to one or more aspects of the present disclosure will be described in detail with reference to the accompanying drawings.

It is noted that various connections may be set forth between elements in the following description. These connections in general and, unless specified otherwise, may be direct or indirect and that this specification is not intended to be limiting in this respect. Aspects of the disclosure may be implemented in computer software as programs storable on computer readable media including but not limited to a random access memory (RAM), a read-only memory (ROM), a flash memory, an EEPROM, a CD-media, DVD-media, temporary storage, hard disk drives, floppy drives, permanent storage, and the like.

[Overall Configuration of Printer]

Figure 1:
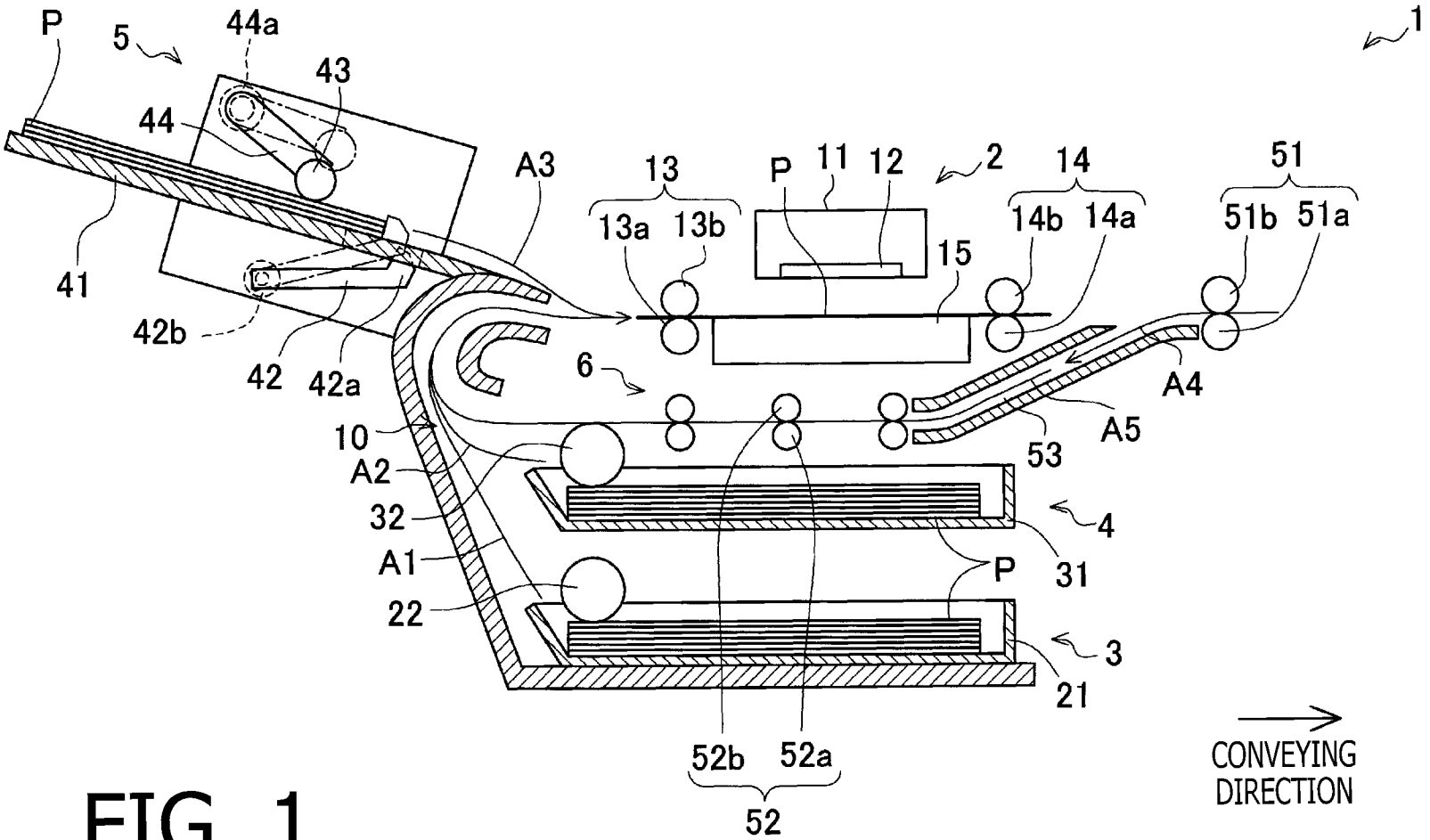
FIG. 1 is a schematic cross-sectional view of a printer according to an exemplary embodiment of the present invention.
Figure 2:
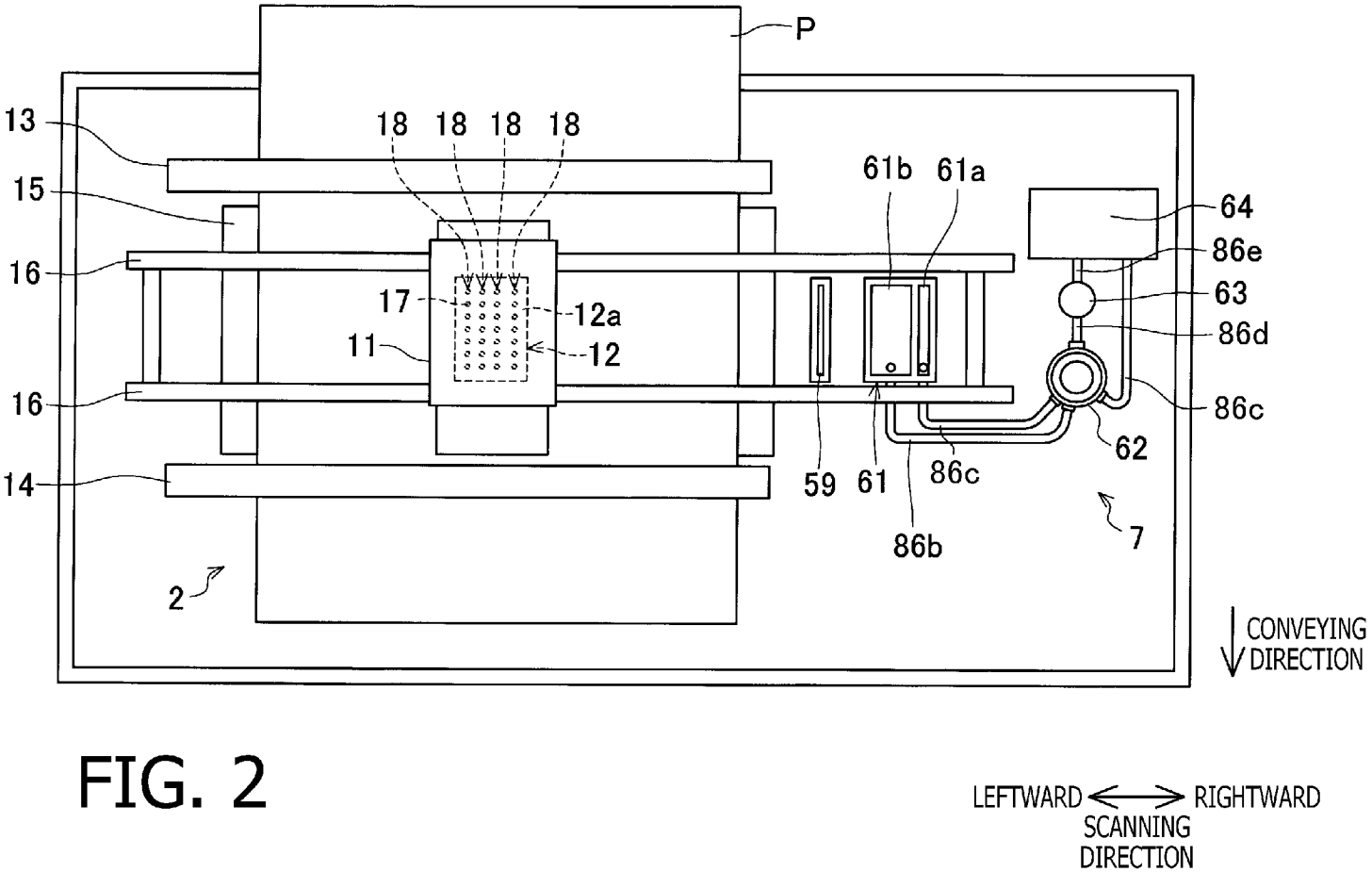
FIG. 2 is a plan view of a printing unit and a maintenance unit in the printer according to the embodiment of the present disclosure.

As shown in FIGS. 1 and 2, a printer 1 of the present embodiment includes a printing unit 2, a lower cassette feeder 3, an upper cassette feeder 4, a tray feeder 5, a sheet reversing unit 6, and a maintenance unit 7.

[Printing Unit]

The printing unit 2 includes a carriage 11, an inkjet head 12, conveyer rollers 13, 14, and a platen 15. The carriage 11 is supported by two (2) guide rails 16, which extend along a scanning direction, to be movable thereon along the scanning direction. The carriage 11 is connected with a carriage motor 156 (see FIG. 13) through a belt and a pulley, which are not shown, to be driven by the carriage motor 156 to reciprocate along the scanning direction. In the following description, one side and an opposite side along the scanning direction are defined as a right-hand side and a left-hand side respectively, as shown in FIG. 2. The scanning direction may include a leftward (right-to-left) direction and a rightward (left-to-right) direction.

The inkjet head 12 is mounted on the carriage 11. The inkjet head 12 is configured to discharge ink from a plurality of nozzles 17 formed on an ink discharging surface 12*a*, which is a lower surface of the inkjet head 12, at a discharge-object medium. The ink discharging surface 12*a* spreads in parallel with a conveying direction, which is a direction to convey a recording sheet P and is orthogonal to the scanning direction, and the nozzles 17 are formed on the ink discharging surface 12*a* in lines to form nozzle rows 18 that extend along the conveying direction. In the inkjet head 12, a plurality of, e.g., four (4), nozzle rows 18 are formed so that inks in four colors, e.g., black, yellow, cyan, and magenta, may be discharged separately from each nozzle row 18. For example, the nozzles 17 in the rightmost nozzle row 18 may discharge pigmentary black ink, and the nozzles 17 in the nozzle rows 18 from the second, third, and fourth to the right may discharge yellow, cyan, and magenta pigmentary inks, respectively.

The conveyer roller 13 is located in an upstream position from the carriage 11, or the inkjet head 12, with regard to the conveying direction. The conveyer roller 13 includes a driving roller 13*a* and a driven roller 13*b* disposed in an upper position with respect to the driving roller 13*a*. The driving roller 13*a* is connected with a PF motor 101 (see FIGS. 9A-9E). When the PF motor 101 rotates in a reverse direction (e.g., counterclockwise), a driving force from the PF motor 101 is transmitted to the driving roller 13*a*, and the driving roller 13*a* rotates in, for example, clockwise in FIG. 1. Thereby, the recording sheet P nipped between the driving roller 13*a* and the driven roller 13*b* may be conveyed in the conveying direction. Meanwhile, when the PF motor 101 rotates in a normal direction (e.g., clockwise), the driving roller 13*a* rotates in, for example, counterclockwise in FIG. 1.

The conveyer roller 14 is located in a downstream position from the carriage 11, or the inkjet head 12, with regard to the conveying direction. The conveyer roller 14 includes a driving roller 14*a* and a driven roller 14*b* disposed in an upper position with respect to the driving roller 14*a*. The driving roller 14*a* is coupled with the driving roller 13*a* through multiple gears, which are not shown. Thereby, when the driving force from the PF motor 101 is transmitted to the driving roller 13*a*, the driving force is further transmitted to the driving roller 14*a* so that the driving roller 14*a* is rotated along with the driving roller 13*a*. The conveyer roller 14*a* rotates in the same direction as the conveyer roller 13*a*.

Accordingly, when the PF motor 101 rotates in the reverse direction, the recording sheet P nipped between the driving roller 14*a* and the driven roller 14*b* may be conveyed in the conveying direction.

The platen 15 is arranged in a position between the conveyer roller 13 and the conveyer roller 14 along the conveying direction to face the ink discharging surface 12*a*. The platen 15 may support the recording sheet P conveyed by the conveyer rollers 13, 14 from below.

[Lower Cassette Feeder]

The lower cassette feeder 3 is located in a lower position with respect to the platen 15. The lower cassette feeder 3 includes a sheet cassette 21 and a feeder roller 22. The sheet cassette 21 may store one or more recording sheets P in a stack. The feeder roller 22 may be connected with an ASF motor 102 (see FIGS. 10A-10E) through multiple gears including a lower feeder gear 131 (FIGS. 9A-9E, solely the lower feeder gear 131 among the multiple gears is shown). While the feeder roller 22 is connected with the ASF motor 102, and when the ASF motor 102 is activated to rotate in the normal direction, the driving force from the ASF motor 102 is transmitted to the feeder roller 22 so that the feeder roller 22 rotates in the clockwise direction in FIG. 1. Accordingly, the recording sheet P stored in the sheet cassette 21 may be conveyed toward a position on an upstream side of the conveyer roller 13 in the conveying direction. In a range between the sheet cassette 21 and the position on the upstream side of the conveyer roller 13, formed is a feeder path 10, which may guide the recording sheet P from the sheet cassette 21 to the conveyer roller 13. Thus, the recording sheet P fed by the feeder roller 22 may be conveyed in the feeder path 10, in a sheet-flowing direction A1, to the position on the upstream side of the conveyer roller 13 with regard to the conveying direction to be fed to the printing unit 2.

[Upper Cassette Feeder]

The upper cassette feeder 4 is located in a position between the platen 15 and the lower cassette feeder 3. The upper cassette feeder 4 includes a sheet cassette 31 and a feeder roller 32. The sheet cassette 31 is in a configuration similar to the sheet cassette 21 and may store one or more recording sheets P in a stack. The feeder roller 32 may be connected with the ASF motor 102 through multiple gears including an upper feeder gear 132 (see FIGS. 9A-9E, solely the upper feeder gear 132 among the multiple gears is shown). While the feeder roller 32 is connected with the ASF motor 102, and when the ASF motor 102 is activated to rotate in the reverse direction, the driving force from the ASF motor 102 is transmitted to the feeder roller 32 so that the feeder roller 32 rotates in the clockwise direction in FIG. 1. Accordingly, the recording sheet P stored in the sheet cassette 31 may be fed to the position on the upstream side of the conveyer roller 13 with regard to the conveying direction through the feeder path 10, in a sheet-flowing direction A2, to be fed to the printing unit 2.

[Tray Feeder]

The tray feeder 5 is located on the upstream side of the conveyer roller 13 with regard to the conveying direction. The tray feeder 5 includes a feeder tray 41, a stopper 42, and a feeder roller 43. On an upper surface of the feeder tray 41, one or more recording sheets P may be placed. The recording sheet P on the feeder tray 41 may be conveyed in a sheet-flowing direction A3 toward the position on the upstream side of the conveyer roller 13. The feeder tray 41 is formed to have a through hole 41*a* in vicinity of an end of the feeder tray 41 closer to the position on the upstream side of the conveyer roller 13 along the sheet-flowing direction A3. Meanwhile, the stopper 42 is arranged to longitudinally extend along the sheet-flowing direction A3 with a downstream end thereof with regard to the sheet-flowing direction A3 being arranged to coincide with the through hole 41*a*. On a downstream end of the stopper 42 with regard to the sheet-flowing direction A3, formed is a projection 42*a*, which projects upward. The stopper 42 is attached to a gear 42*b* at an upstream end portion thereof with regard to the sheet-flowing direction A3. Therefore, the stopper 42 may swing about an axis of the gear 42*b* along with rotation of the gear 42*b*.

The feeder roller 43 is located in an upper position with respect to the feeder tray 41. The feeder roller 43 is attached to an end portion of an arm 44 arranged to longitudinally extend along the sheet-flowing direction A3. Specifically, the feeder roller 43 is rotatably supported by a downstream end portion, with regard to the sheet-flowing direction A3, of the arm 44. An upstream end portion of the arm 44 with regard to the sheet-flowing direction A3 is attached to a gear 44*a*. Therefore, the arm 44 may swing about an axis of the gear 44*a* along with rotation of the gear 4*a*.

The gear 42*b*, the feeder roller 43, and the gear 44*a* are coupled with one another through multiple gears including a tray-feeder gear 133 (see FIGS. 9A-9E, solely the tray-feeder gear 133 among the multiple gears is shown) and may be connected with the ASF motor 102. While the gear 42, the feeder roller 43, and the gear 44*a* are connected with the ASF motor 102, and when the ASF motor 102 is activated to rotate in the normal direction, the driving force from the ASF motor 102 is transmitted to the gears 42*b*, 44*a* to rotate the gears 42*a*, 44*a* clockwise in FIG. 1 so that the feeder roller 43 rotates counterclockwise in FIG. 1. On the other hand, when the ASF motor 102 is activated to rotate in the reverse direction, the driving force from the ASF motor 102 is transmitted to the gears 42*b*, 44*a* to rotate the gears 42*b*, 44*a* counterclockwise so that the feeder roller 43 rotates in the clockwise direction in FIG. 1.

In the tray feeder 5, when no recording sheet P is to be fed to the printing unit 2, the stopper 42 is placed in a position indicated by a dash-and-dot line in FIG. 1, in which the projection 42*a* protrudes upward through the through hole 41*a*. Accordingly, leading ends, or downstream ends with regard to the sheet-flowing direction A3, of the recording sheets P stored in the feeder tray 41 may contact the projection 42*a* to be restricted from moving from the tray feeder 5 toward the printing unit 2. Meanwhile, the arm 44 is placed in a position to have the feeder roller 43 to be separated apart from the recording sheets P in the feeder tray 41.

In contrast, when the recording sheet P is to be fed from the tray feeder 5 to the printing unit 2, the gear 42*b*, the feeder roller 43, and the gear 44*a* are placed in the condition to be connected with the ASF motor 102, and the ASF motor 102 is activated to rotate in the normal direction. According to the rotation of the gear 42*b*, the stopper 42 may swing clockwise in FIG. 1, and, as indicated in solid lines in FIG. 1, an upper end portion of the projection 42*a* may be drawn in the through hole 41*a*. Thus, the recording sheets P stored in the feeder tray 41 may be released from the restriction by the projection 42*a* and allowed to move in the sheet-flowing direction A3 toward the printing unit 2. Meanwhile, the arm 44 may swing clockwise in FIG. 1 by the rotation of the gear 44*a* and, as indicated by the solid lines in FIG. 1, the feeder roller 43 may contact the recording sheet P in the feeder tray 41. As the feeder roller 43 rotates counterclockwise in FIG. 1, the recording sheet P stored in the feeder tray 41 may be conveyed in the sheet-flowing direction A3 toward the printing unit 2. When the feeding action to feed the recording sheet P to the printing unit 2 is completed, with the gear 42*a*, the feeder roller 43, and the gear 44*a* being connected with the ASF motor 102, the ASF motor 102 is rotated in the reverse direction so that the stopper 42 and the arm 44 along with the feeder roller 43 are placed back in the positions indicated by the dash-and-dot lines in FIG. 1.

[Sheet Reversing Unit]

The sheet reversing unit 6 includes, as shown in FIGS. 1 and 2, a switchback roller 51 and a plurality of rollers 52. The switchback roller 51 is located in a position downstream from the conveyer roller 14 with regard to the conveying direction. The switchback roller 51 includes a driving roller 51*a* and a driven roller 51*b* arranged in an upper position with respect to the driving roller 51*a*. The driving roller 51*a* is coupled with the driving rollers 13*a*, 14*a* through multiples gears, which are not shown. Therefore, the driving force from the PF motor 101 transmitted to the driving roller 13*a* is further transmitted to the driving roller 51*a* so that the driving roller 51*a* rotates along with the driving roller 13*a*. The driving roller 51*a* rotates in the same direction as the driving rollers 13*a*, 14*a*.

Thus, while the driving roller 13*a* is connected with the ASF motor 102, and when the PF motor 101 is activated to rotate in the reverse direction, the switchback roller 51 may convey the recording sheet P nipped between the driving roller 51*a* and the driven roller 51*b* in the conveying direction. Meanwhile, while a trailing end, or an end on the upstream side with regard to the conveying direction, of the recording sheet P is in a position on an upstream side of the switchback roller 51 with regard to the conveying direction, the rotating direction of the PF motor 101 may be switched to the normal direction. Thereby, the recording sheet P may be conveyed in a sheet-flowing direction A4 by the switchback roller 51 to be reversed in a reversing path 53, which is branched to extend downward from the conveying direction, toward the position on the upstream side of the conveyer roller 13.

The plurality of rollers 52 are located between the platen 15 and the sheet cassette 31 to align in positions closer than the reversing path 53 to the position on the upstream side of the conveyer roller 13 along the sheet-flowing direction A4. Each of the rollers 52 includes a driving roller 52*a* and a driven roller 52*b* arranged in an upper position with respect to the driving roller 52*a*. The driving roller 52*a* is coupled with the feeder roller 32 through multiple gears, which are not shown. Therefore, the driving force from the ASF motor 102 transmitted to the feeder roller 32 is further transmitted to the driving rollers 52*a* so that the driving rollers 52*a* rotate along with the feeder roller 32. Thus, when the ASF motor 102 rotates in the normal direction, the driving roller 52*a* may rotate counterclockwise in FIG. 1, and the recording sheet P conveyed to the reversing path 53, nipped between the driving rollers 52*a* and the driven rollers 52*b*, may be conveyed in a sheet-flowing direction A5 toward the feeder path 10 and to the position on the upstream side of the conveyer roller 13 with regard to the conveying direction. Simultaneously, the feeder roller 32 may rotate counterclockwise in FIG. 1 to convey the recording sheet P together with the rollers 52 toward the feeder path 10 so that the recording sheet P may be inverted upside-down and conveyed to return to the printing unit 2.

[Maintenance Unit]

As shown in FIGS. 2-8, the maintenance unit 7 includes a wiper 59, a capping unit 64, a switcher valve 62, an aspirator pump 63, and a waste liquid tank 64.

<Wiper>

The wiper 59 is located on one side, e.g., a leftward side, of the platen 15. The wiper 59 is movable vertically by a wiper-lifting device 157 (see FIG. 13). When the wiper 59 is placed in an upper position by the wiper-lifting device 59, an upper end of the wiper 59 may be at an equal or higher level than the ink discharging surface 12*a* of the inkjet head 12. Therefore, when the carriage 11 is moved in a range that coincides with the wiper 59, the ink discharging surface 12*a* of the inkjet head 12 may contact the wiper 59 in the upper position. Meanwhile, when the wiper 59 is in a lower position, the upper end of the wiper 59 may be at a lower level than the ink discharging surface 12*a*. Therefore, when the carriage 11 is moved in the range that coincides with the wiper 59, the ink discharging surface 12*a* may not contact the wiper 59 in the lower position.

<Capping Unit>

The capping unit 61 may include two (2) nozzle caps 61*a*, 61*b*, which may be integrally formed. The nozzle caps 61*a*, 61*b* are in an arrangement, in which the nozzle cap 61*a* adjoins rightward the nozzle cap 61*b* along the scanning direction. When the carriage 11 is moved to a range, in which the nozzle discharging surface 12*a* faces the capping unit 61, the rightmost one of the nozzle rows 18 vertically coincides with the nozzle cap 61*a*, and the other three (3) nozzle rows 18 on the left vertically coincide with the nozzle cap 61*b*. The capping unit 61 is movable vertically by a cap-lifting device 66 between a contacting position (see FIG. 6B) and a separated position (see FIG. 6B). While the ink discharging surface 12*a* is in the position to face with the capping unit 61, and when the capping unit 61 is uplifted by the cap-lifting device 66, the capping unit 61 may be placed to fit closely with or to seal the ink discharging surface 12*a*. Therefore, the rightmost nozzle row 18 may be covered with by the nozzle cap 61*a*, and the leftward three nozzle rows 18 may be covered with by the nozzle cap 61*b*.

<Cap-Lifting Device>

Figure 3A:
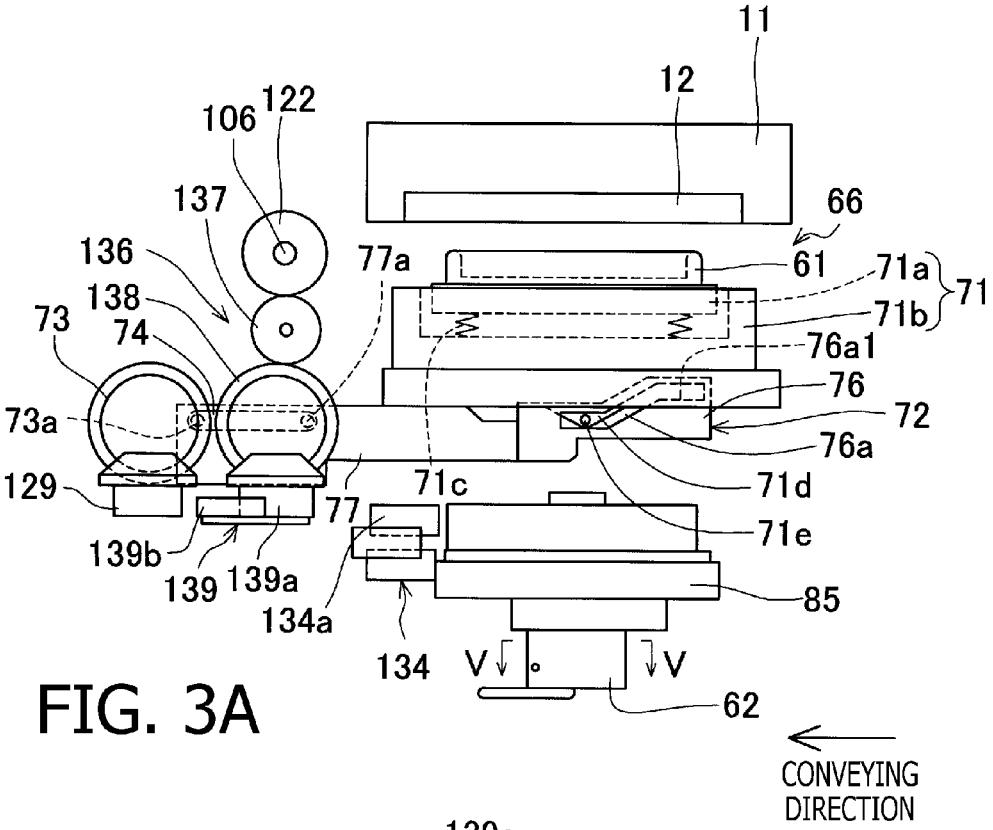
FIG. 3A is a leftward side view of a cap-lifting device, a switcher valve, and gears in the printer according to the embodiment of the present disclosure.
Figure 3B:
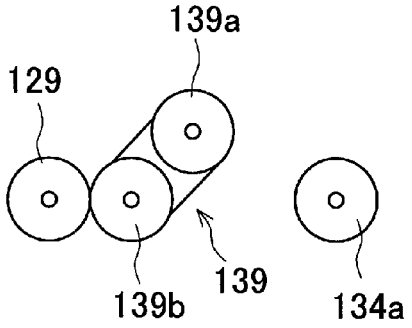
FIGS. 3B-3C are illustrative views of the gears in the printer according to the embodiment of the present disclosure.
Figure 3C:
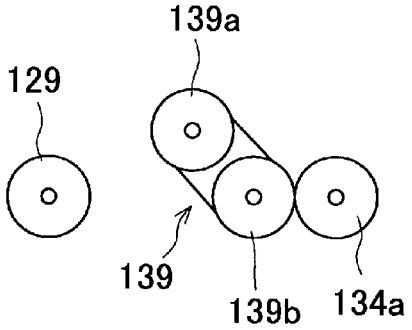
Figure 4:
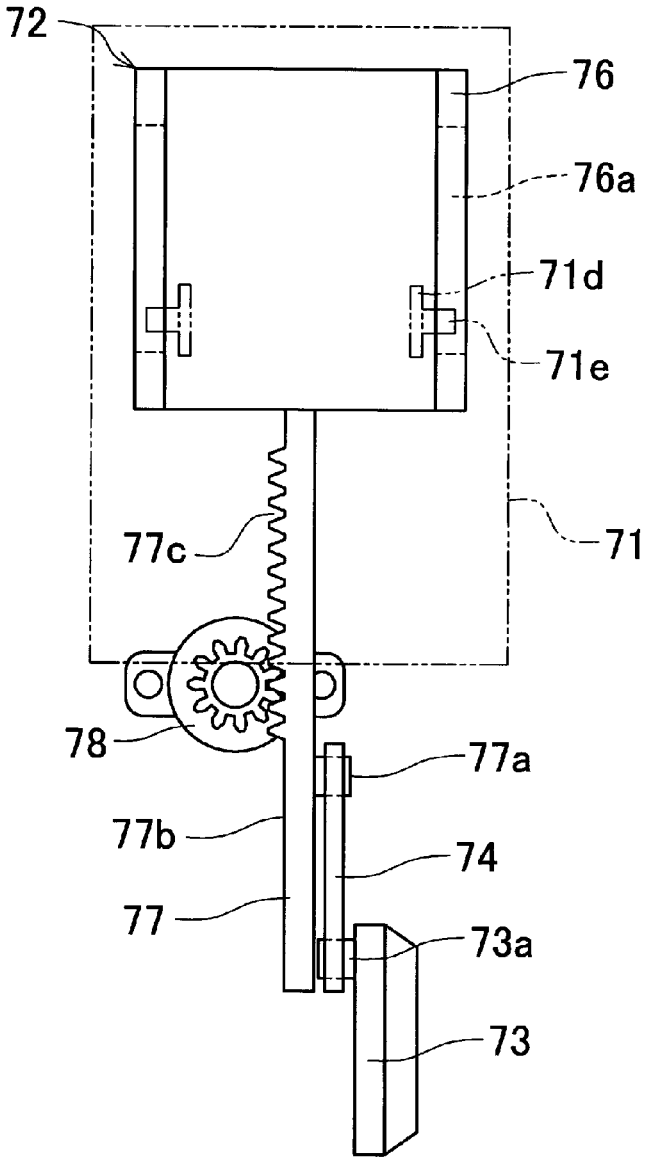
FIG. 4 is a plan view of a slider in the printer according to the embodiment of the present disclosure.
Figure 4:
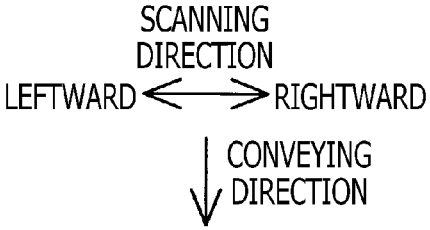

The cap-lifting device 66 includes, as shown in FIGS. 3-4, a cap retainer 71, a slider 72, a crank gear 73, and an arm 74. The cap retainer 71 includes a cap holder 71*a* and a lifting-lowering member 71. The cap holder 71*a* supports the capping unit 61 from below to provide rigidity to the capping unit 61. The lifting member 71 accommodates the cap holder 71*a* and is supported by a guide (not shown) to be vertically movable. The cap retainer 71 further includes a spring 71*c*, which is arranged between the cap holder 71*a* and the lifting-lowering member 71; thereby, the cap holder 71*a* is urged upward. In each end of a lower surface of the lifting-lowering member 71 along the scanning direction, arranged is a protrusion 71*d*, which protrudes downward, and on an outward surface of the protrusion 71*d* with regard to the scanning direction, formed is a projection 71*e*, which is formed to extend outward along the scanning direction.

The slider 72 includes two (2) parts 76, 77. The part 76 is arranged in a lower position with respect to the lifting-lowering member 71. On each lateral face of the part 76 along the scanning direction, formed is a groove 76*a*, in which the projection 71*e* may be inserted. The groove 76*a* is formed to extend longitudinally in parallel with the conveying direction at each lengthwise end section and to incline in an intermediate section to be higher on an upstream side and lower on a downstream side with regard to the conveying direction. The projection 71*e* is disposed in the groove 76*a* to contact a bottom 76*a*1 of the groove 76*a*.

The part 77 is formed to be narrower than the part 76 with regard to the scanning direction and extends longitudinally downstream in the conveying direction from a central area in the scanning direction of a downstream end of the part 76. On a downstream end in the conveying direction of the part 77, disposed is an arm holder 77*a*, which protrudes along the scanning direction to support one end of the arm 74 swingably. On a leftward face 77*b* in the scanning direction of the part 77, formed is a gear 77*c*, which is elongated along the conveying direction. Meanwhile, the slider 72 is provided with an oil damper 78 to mesh with the gear 77*c*. The oil damper 78 may prevent the slider 72 from sliding abruptly along the conveying direction.

The crank gear 73 is placed in an arrangement such that an axis thereof aligns in parallel with the scanning direction. On a lateral face of the crank gear 73 in a position displaced from a center with regard to the conveying direction, arranged is an arm support 73*a*, by which the other end of the arm 74 is rotatably supported. The crank gear 73 is meshed with a bevel gear 129.

<Switcher Valve>

Figure 5:
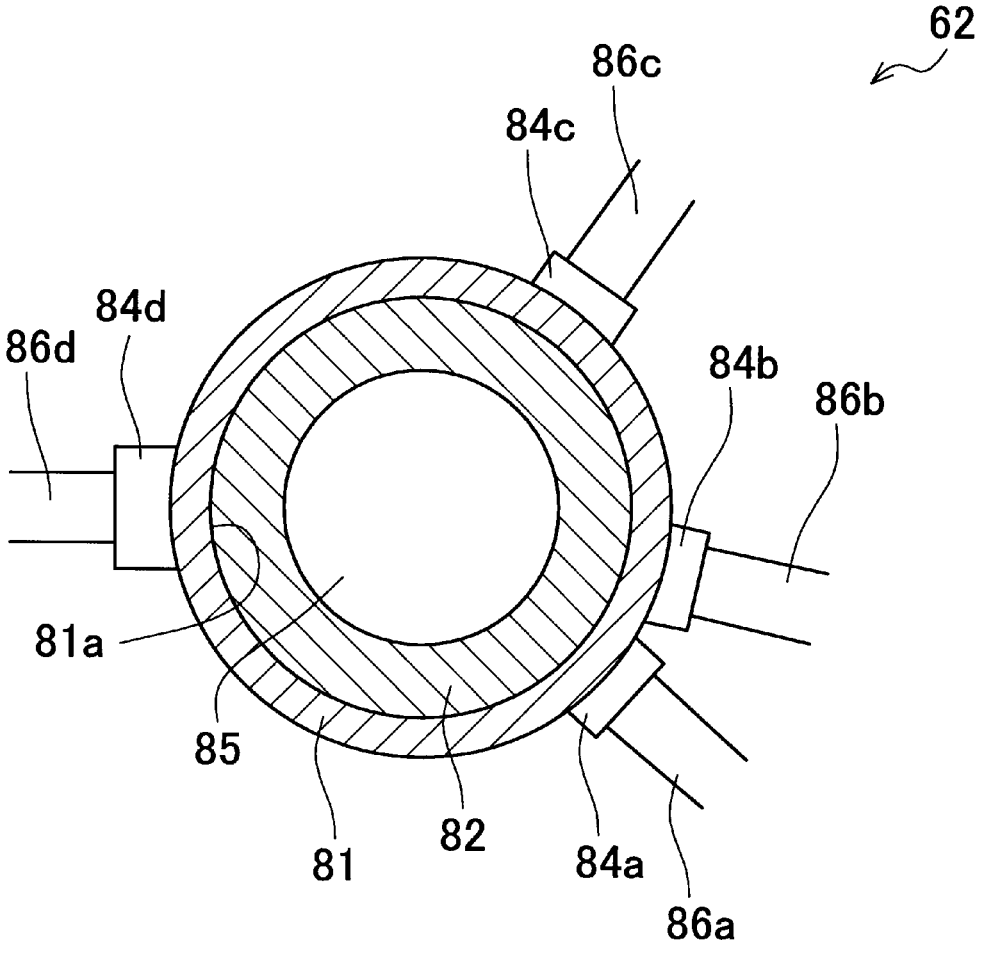
FIG. 5 is a cross-sectional view of the switcher valve in the printer according to the embodiment of the present disclosure taken along a line V-V in FIG. 3.

The switcher valve 62 includes, as shown in FIG. 5, a casing 81 and a flow-channel member 82. The casing 81 is formed in a shape of a cylindrical dish having a bottom. The casing 81 includes two (2) cap-communication ports 84*a*, 84*b*, an air-communication port 84*c*, and a pump-communication port 84*d*. These ports 84*a*-84*d* are connected with an inner room 81*a* and are formed to protrude outward in different radial directions of the casing 81 from one another. The cap-communication port 84*a* is connected with the nozzle cap 61*a* through a tube 86*a*. The cap-communication port 84*b* is connected with the nozzle cap 61*b* through a tube 86*b*. The air-communication port 84*c* is connected with the waste liquid tank 64 through a tube 86*c*. The pump-communication port 84*d* is connected with the aspirator pump 63 through a tube 86*d*.

The flow-channel member 82 is made in, for example, rubber and has a cylindrical shape. The flow-channel member 82 is rotatably accommodated in the inner room 81*a* of the casing 81. The flow-channel member 82 is formed to have grooves (not shown), through which the ports 84*a*-84*d* may be connected to be in fluid communication with one another. The flow-channel member 82 is attached to a valve cam 85 and is connected with a valve-drivable gear assembly 134, which includes a valve-drivable gear 134*a*. The switcher valve 62 to switch connection and disconnection among the ports 84*a*-84*d* may be in a known configuration; therefore, detailed description of the switcher valve 62 is herein omitted.

<Selector-Gear System>

According to the present embodiment, the driving force from the ASF motor 102 may be selectively transmitted to one of the cap-lifting device 66 and the switcher valve 62 through a selector-gear system 136. The selector-gear system 136 may switch transmission destinations for the driving force from the ASF motor 102 to transmit the driving force to either the cap-lifting device 66 or the switcher valve 62 depending on a rotating direction of the ASF motor 102. As shown in FIG. 3A, the selector-gear system 136 may include a selector-drivable gear 137, a bevel gear 138, and a planetary gear system 139. The selector-drivable gear 137 may be engaged with an ASF switchable gear 122, which is described later in detail. When engaged with the ASF switchable gear 122, the selector-drivable gear 137 is connected with the ASF motor 102. The bevel gear 138 is engaged with the selective gear 137. The planetary gear system 139 includes a sun gear 139*a* and a planet gear 139*b*. The sun gear 139*a* is engaged with the bevel gear 138 and is rotatable along with rotation of the selector-drivable gear 137 and the bevel gear 138. The planet gear 139*b* is engaged with the sun gear 139*a*, and when the sun gear 139*a* rotates, the planet gear 139*b* rotates about an axis thereof and revolves around the sun gear 139*a* about an axis of the sun gear 139*a*.

While the selector-drivable gear 137 is connected with the ASF motor 102, when the ASF motor 102 rotates in the normal direction, the driving force from the ASF motor 102 is transmitted to the selector-drivable gear 137, the bevel gear 138, the sun gear 139*a*, and the planet gear 139*b*. Therefore, as shown in FIGS. 3B and 6A-6B, the sun gear 139*a* rotates counterclockwise in FIG. 3B, and the planet gear 139*b* revolves about the axis of the sun gear 139*a* clockwise in FIG. 3B on a horizontal plane to be engaged with the bevel gear 129. As the ASF motor 102 continues to rotate in the normal direction, the driving force from the ASF motor 102 is transmitted to the crank gear 73 through the bevel gear 129 to rotate the crank gear 73 counterclockwise in FIG. 3A; thereby, the slider 72 is moved to reciprocate along the conveying direction.

When the slider 72 moves upstream with regard to the conveying direction, as shown in FIG. 6A, the projection 71*e* of the lifting-lowering member 71 is guided on the bottom 76*a*1 of the groove 76*a* to the lower-leftward area in the groove 76*a*, and the cap retainer 71 and the capping unit 61 are lowered accordingly. On the other hand, when the slider 72 moves downstream with regard to the conveying direction, as shown in FIG. 6B, the projection 71*e* of the lifting-lowering member 71 is guided on the bottom 76*a*1 of the groove 76*a* to the upper-rightward area in the groove 76*a*. Thereby, the cap retainer 71 and the capping unit 61 are uplifted. Meanwhile, the oil damper 78 rotates along with the sliding movement of the slider 72. Thus, in the cap-lifting device 66, the rotation of the crank gear 73 in one direction is converted into the sliding reciprocating movement of the slider 72 along the conveying direction, with the projection 71*e* of the lifting-lowering member 71 being guided on the bottom 76*a*1 of the groove 76*a* in the slider 72, the cap retainer 71 and the capping unit 61 are uplifted.

On the other hand, while the selector-drivable gear 137 is connected with the ASF motor 102, when the ASF motor 102 rotates in the reverse direction, the driving force from the ASF motor 102 is transmitted to the selector-drivable gear 137, the bevel gear 138, the sun gear 139*a*, and the planet gear 139*b*. Therefore, as shown in FIGS. 3C and 7, the sun gear 139*a* rotates clockwise in FIG. 3C, and the planet gear 139*b* revolves about the axis of the sun gear 139*a* counterclockwise in FIG. 3C on the horizontal plane to be engaged with the valve-drivable gear 134*a*. As the ASF motor 102 continues to rotate in the reverse direction, the driving force from the ASF motor 102 is transmitted to the valve-drivable gear 134*a* and rotate the valve-drivable gear assembly 134 and rotate the valve cam 85 and the flow-channel member 82. Thus, the flow-channel member 82 rotates in the switcher valve 62 so that connection or disconnection between the cap-communication ports 84*a*, 84*b* and the pump-communication port 84*d* and connection among the communication ports 84*a*-84*d* may be switched.

The aspirator pump 63 may be a tubed pump and is connected with the pump-communication port 84*d* of the switcher valve 62 on one side through the tube 86*d* and with the waste liquid tank 64 on a opposite side from the switcher valve 62 through a tube 86*e*. As shown in FIG. 8, the aspirator pump 63 includes a gear 63*a*. The gear 63*a* is connected with a pump-drivable gear assembly 141, which includes a pump-drivable gear 141*a*, and may be connected with the PF motor 101 through the pump-drivable gear 141*a*. While the aspirator pump 63 is connected with the PF motor 101, and when the PF motor 101 rotates in the normal direction, the driving force from the PF motor 101 is transmitted to the aspirator pump 63, and the aspirator pump 63 is placed in a disconnected condition, in which the tube 86*d* and the tube 86*e* are disconnected from each other. As the PF motor 101 continues to rotate in the normal direction, the aspirator pump 63 may aspirate the fluid. On the other hand, when the PF motor 101 rotates in the reverse direction, the driving force from the PF motor 101 is transmitted to the aspirator pump 63, and the aspirator pump 63 is placed in a connected condition, in which the tubes 86*d*, 86*e* are connected with each other. The configuration of the aspirator pump 63, in which connection and disconnection between the tubes may be switched depending on the rotating direction of the motor, is known; therefore, detailed description is herein omitted.

The waste liquid tank 64 may store waste liquid, and the like, such as purged ink, which will be described later in detail. A room in the waste liquid tank 64 to contain the waste ink is in fluid communication with the atmosphere. Therefore, the waste liquid tank 64 and the air-communication port 84*c* are in fluid communication through the tube 86*c*. When the aspirator pump 63 is in the connected condition, the pump-communication port 84*d* is in fluid communication with the atmosphere through the tubes 86*d*, 86*e*, the aspirator pump 63, and the waste liquid tank 64.

[Connection and Disconnection with Motors]

Next, switching the connection and disconnection of the PF motor 101 and the ASF motor 102 will be described with reference to FIGS. 9A-9E, 10A-10E, 11, and 12. In FIGS. 11 and 12, connection between two or more items illustrated in solid lines indicates that these items are maintained connected at all times, and connection illustrated in broken lines indicates that two of these items are selectively connectable with each other.

As shown in FIGS. 9A-9E and 11, the PF motor 101 is connected with a driving shaft 105, and the driving roller 13*a* is attached to the driving shaft 105. Further, the driving shaft 105 is attached to a PF input gear 111. When the PF motor 101 rotates, the driving shaft 105, the driving roller 13*a*, and the PF input gear 111 rotate integrally.

The PF input gear 111 is engaged with a PF switchable gear 112. The PF switchable gear 112 is rotatably supported by a shaft 106, which extends along the scanning direction. The PF switchable gear 112 is movable along the scanning direction on the shaft 106 in conjunction with the reciprocation of the carriage 11 in the scanning direction. Thereby, the PF switchable gear 112 is movable selectively to one of positions illustrated in FIGS. 9A-9E. While in any of the positions illustrated in FIGS. 9A-9D, the PF switchable gear 112 is not engaged with the pump-drivable gear 141*a*. While in the position illustrated in FIG. 9E, the PF switchable 112 is engaged with the pump-drivable gear 141*a*. Meanwhile, the PF switchable gear 112 is engaged with the PF input gear 111 in any of the positions illustrated in FIGS. 9A-9E.

Meanwhile, as shown in FIGS. 9A-9E, 10A-10E, and 12, the ASF motor 102 is connected with the ASF input gear assembly 121. The ASF input gear assembly 121 includes an ASF input gear 121*a*, which is engaged with the ASF switchable gear 122. The ASF switchable gear 122 is supported rotatably by the shaft 106. The ASF switchable gear 122 is attached to the shaft 106 in an arrangement such that positional relation between the ASF switchable gear 122 and the PF switchable gear 112 in the scanning direction is maintained at all times. Therefore, when the PSF switchable gear 112 is moved in the scanning direction along with the reciprocation of the carriage 11, the ASF switchable gear 122 likewise moves in the scanning direction.

Thus, the PF and ASF switchable gears 112, 122 may be moved in the scanning direction to be selectively in one of the positions illustrated in FIGS. 9A-9E. The ASF switchable gear 122 is, when in the position illustrated in FIG. 9A, engaged with the upper feeder gear 132, and when in the position illustrated in FIG. 9B, engaged with the lower feeder roller 131. When in the position illustrated in FIG. 9C, the ASF switchable gear 122 is engaged with the tray-feeder gear 133, and when in the positions illustrated in FIGS. 9D and 9E, the ASF switchable gear 122 is engaged with the selector-drivable gear 137.

[Controller]

Next, a controller 150 to control behaviors and actions in the printer 1 will be described. The controller 150 includes, as shown in FIG. 13, a central processing unit (CPU) 151, a read only memory (ROM) 152, a random access memory (RAM) 153, an application specific integrated circuit (ASIC) 154, which in conjunction control the behaviors of the devices in the printer 1 including the carriage motor 156, the inkjet head 12, the PF motor 101, and the ASF motor 102.

While FIG. 13 shows solely one (1) CPU 151 to process signals or jobs in the controller 150, the CPU 151 may not necessarily be limited to a single CPU 151 that processes the signals or the jobs alone but may include multiple CPUs 151 that may share loads of the processes. Further, the ASIC 154 in the controller 150 may not necessarily be limited to a single ASIC that processes the signals or the jobs alone but may include multiple ASICs 55 that may share loads of the processes.

[Printing Operation]

Next, a flow of steps in a printing operation to print an image on the recording sheet P will be described. In the printing operation, the controller 150 may conduct the flow of steps shown in FIG. 14. When the printer 1 is in a standby state, in which no printing or maintenance operation is conducted, the capping unit 61 is fitted to the ink discharging surface 12*a* so that the ink in the nozzles 17 may be prevented from the air and from drying. Further, when in the standby state, communication between the cap-communication ports 84*a*, 84*b* and the pump-communication port 84*d* is established in the switcher valve 62 (see FIG. 15A). Meanwhile, the aspirator pump 63 is in the connected condition. Therefore, in the standby state, the nozzle caps 61*a*, 61*b* to cover the nozzles 17 are in fluid communication with the atmosphere through the aspirator pump 63. Further, in the standby state, the PF switchable gear 112 and the ASF switchable gear 122 are in the positions illustrated in FIG. 9E. In this regard, in FIG. 15A, a bidirectional arrow in the aspirator pump 63 indicates that the aspirator pump 63 is in the connected condition.

As shown in FIG. 14, in order to print an image in the printer 1, in S101, the controller 150 manipulates the ASF motor 102 to rotate in the normal direction to lower the capping unit 61. In S102, the controller 150 manipulates one of the sheet cassettes 21, 31, and the feeder tray 41 to feed the recording sheet P to the printing unit 2. For example, the controller 150 may move the carriage 11 to move the PF switchable gear 112 and the ASF switchable gear 122 to one of the positions illustrated in FIGS. 9A-9C. If the PF and ASF switchable gears 112, 122 are in the positions illustrated in FIG. 9A, the controller 150 activates the ASF motor 102 to rotate in the reverse direction. If the PF and ASF switchable gears 112, 122 are in either of the positions illustrated in FIGS. 9B and 9C, the controller 150 activates the ASF motor 102 to rotate in the normal direction.

In S103, the controller 150 determines whether the leading end of the recording sheet P reached the conveyer roller 13. For example, a sensor to detect the recording sheet P may be set in a position upstream from the conveyer roller 13 in the conveying direction, and the determination in S103 may be made based on outputs from the sensor. For another example, a distance, in which the recording sheet P is conveyed, may be calculated based on a rotation amount of the feeder roller 22, 32, or 43, and the determination in S103 may be made based on the calculation. The controller 150 waits until the leading end of the recording sheet P reaches the conveyer roller 13 (S103: NO). When the leading end of the recording sheet P reaches the conveyer roller 13 (S103: YES), the flow proceeds to S104. If the recording sheet P is fed from either the sheet cassette 21 or the sheet cassette 31 (S104: NO), the flow proceeds to S106.

On the other hand, if the recording sheet P is fed from the sheet tray 41 (S104: YES), in S105, the controller 150 manipulates the PF motor 101 to rotate in the normal direction for a predetermined length of time (e.g., 1-2 seconds) so that skew of the recording sheet P with respect to the conveying direction may be corrected. For example, the recording sheet P fed from the sheet tray 41 may reach the conveyer roller 13 in a skewed orientation. When the recording sheet P reached the conveyer roller 13 in the skewed orientation, only a part of the leading end of the recording sheet P may be nipped between the driving roller 13*a* and the driven roller 13*b*. Therefore, in the present embodiment, the PF motor 101 may be rotated in the normal direction to rotate the driving roller 13*a* in the opposite direction from the direction to convey the recording sheet P in the conveying direction. Thereby, the part of the leading end of the recording sheet P that is nipped between the driving roller 13*a* and the driven roller 13*b*, which is on the downstream side of the conveyer roller 13, is released to the upstream side, and the skew of the recording sheet P may be corrected.

Following S104 or S105, in S106, the controller 150 conducts a printing action, in which the recording sheet P is conveyed in the conveying direction, the carriage is moved to reciprocate along the scanning direction, and the ink is discharged through the nozzles 17 of the inkjet head 12 at the recording sheet P being conveyed. For example, by rotating the PF motor 101 in the reverse direction, the conveyer rollers 13, 14 and the switchback roller 51 may be manipulated to convey the recording sheet P in the conveying direction; by activating the carriage motor 156, the carriage 11 may be moved to reciprocate along the scanning direction; and by driving the inkjet head 12, the ink may be discharged through the nozzles 17.

The printing action is continued until the image is printed on the recording sheet P (S107: NO). When printing the image on the recording sheet P is completed (S107: YES), in 5108, the controller 150 stops driving the carriage motor 156 and the inkjet head 12. When no printing is performed on the reversed side of the recording sheet P (S109: NO), in S110, the controller 150 continues to rotate the PF motor 101 in the reverse direction to eject the recording sheet P outside. In S110, the controller 150 places the printer 1 in the standby state and ends the flow.

Meanwhile, in S109, when printing is to be performed on the reversed side of the recording sheet P (S109: YES), in S112, the controller 150 determines whether the trailing end of the recording sheet P reached a position on an upstream side of the switchback roller 51. For example, a sensor to detect the recording sheet P may be set in a position upstream from the switchback 51 in the conveying direction, and the determination in S112 may be made based on outputs from the sensor. For another example, a distance, in which the recording sheet P is conveyed, may be calculated based on a rotation amount of the feeder roller 22, 32, or the switchback roller 51, and the determination in S112 may be made based on the calculation.

The controller 150 continues to rotate the PF motor 101 in the reverse direction to convey the recording sheet P until the trailing end of the recording sheet P reaches the position upstream from the switchback roller 51 in the conveying direction (S112: NO). When the trailing end of the recording sheet P reaches the position upstream from the switchback roller 51 (S112: YES), in S113, the controller 150 inverts the recording sheet P and returns the recording sheet P to the printing unit 2. Specifically, the controller 150 rotates the PF motor 101 in the normal direction to manipulate the switchback roller 51 to convey the recording sheet P to the reversing path 53. Further, with the PF and ASF switchable gears 112, 122 moved to the positions illustrated in FIG. 9A, the controller 150 manipulates the ASF motor 102 to rotate in the normal direction so that the rollers 52 and the feeder roller 32 may convey the recording sheet P conveyed to the reversing path 53 toward the printing unit 2. Following S113, the flow returns to S106.

[Maintenance]

Next, a flow of steps in a maintenance operation with use of the maintenance unit 7 will be described. In the maintenance operation, the controller 150 may conduct the flow of steps shown in FIG. 16.

As the flow starts, in S201, the controller 150 determines whether the flow-channel member 82 is adhered to the casing 81 and immovable. When the controller 150 determines that the flow-channel member 82 is movable (S201: NO), the flow proceeds to S203. When the controller 150 determines that the flow-channel member 82 is immovable (S201: YES), in S202, the controller 150 conducts a valve-cleaning action and proceeds to S203. In S201, for example, in the standby state, when the ASF motor 102 is rotated in the reverse direction, and when current supplied to the ASF motor 102 exceeds a predetermined threshold value due to the immovability of the flow-channel member 82, the controller 150 may determine that the flow-channel member 82 is adhered to the casing 81.

In the valve-cleaning action in S202, the controller 150 manipulates the PF motor 101 in the standby state to rotate in the normal direction, as shown in FIG. 15B, so that the aspirator pump 63 is activated. Accordingly, the ink in the inkjet head 12 is ejected through the nozzles 17 to flow in the switcher valve 62. Thereby, the ink clotted in the switcher valve 62 may absorb the moisture of the ink that flows in the switcher valve 62 and dissolve in the ink so that the adherence of the flow-channel member 82 may be loosened. Further, while the aspirator pump 63 is active, the ASF motor 102 may be rotated in the reverse direction to rotate the flow-channel member 82. Accordingly, the ink may be delivered evenly and entirely to narrower areas in the switcher valve 62. Thereby, the adherence of the flow-channel member 82 to the casing 81 may be cleared. In FIG. 15B and in FIGS. 15C-15F, downward arrows indicate that the aspirator pump 63 in the disconnected condition is aspirating the fluid.

It may be noted that, when aspiration purging or idle aspiration is conducted, which will be described later, the ink flows into the switcher valve 62. If the ink is left inside the switcher valve 62 for an extended period of time, the ink may clot, and the flow-channel member 82 may adhere to the casing 81 by the clotted ink. When the flow-channel member 82 adheres to the casing 81, the flow-channel member 82 may be immobilized in the casing 81 for purging and idle aspiration. When the ink used in the printer 1 is pigmentary ink, which may clot rather easily after being left at the nozzles 17 for a certain length of time, the adherence of the flow-channel member 82 may occur more often. In consideration of this, the valve-cleaning action described above may be conducted so that adherence of the flow-channel member 82 to the casing 81 may be overcome.

In S203, aspiration-purging is conducted. Specifically, aspiration-purging for black, in which the black ink with increased viscosity may be removed from the inkjet head 12, and aspiration-purging for colors, in which the colored inks with increased viscosity may be removed from the inkjet head 12, are conducted continuously.

In the aspiration-purging for black, the capping unit 61 is placed to fit to the ink discharging surface 12*a*, and the PF and ASF switchable gears 112, 122 are placed in the positions illustrated in FIG. 9E. Further, the controller 150 rotates the ASF motor 102 in the reverse direction to rotate the flow-channel member 82. Thereby, as shown in FIG. 15C, the cap-communication port 84*a* and the pump-communication port 84*d* are connected to communicate with each other, and the cap-communication port 84*b* and the air-communication port 84*c* are connected to communicate with each other. In this condition, the controller 150 rotates the PF motor 101 in the normal direction so that the aspirator pump 63 is activated to aspirate the fluid. Thereby, the black ink with the increased viscosity in the inkjet head 12 may be ejected through the nozzles 17 in the rightmost nozzle row 18. Meanwhile, the cap-communication port 84*b* and the air-communication port 84*c* are maintained in fluid communication so that pressure in the nozzle cap 61*b* may be restrained from increasing when a volume in the nozzle cap 61*b* is reduced due to deformation of the cap unit 61 during the aspiration.

In aspiration-purging for colors, the capping unit 61 is placed to fit to the ink discharging surface 12*a*, and the PF and ASF switchable gears 112, 122 are placed in the positions illustrated in FIG. 9E. Further, the controller 150 rotates the ASF motor 102 in the reverse direction to rotate the flow-channel member 82. Thereby, as shown in FIG. 15D, the cap-communication port 84*b* and the pump-communication port 84*d* are connected to communicate with each other, and the cap-communication port 84*b* and the air-communication port 84*c* are connected to communicate with each other. In this condition, the controller 15 rotates the PF motor 101 in the normal direction so that the aspirator pump 63 is activated to aspirate the fluid. Thereby, the colored inks with the increased viscosity in the inkjet head 12 may be ejected through the nozzles 17 in the three nozzle rows 18 on the left. Meanwhile, the cap-communication port 84*a* and the air-communication port 84*c* are maintained in fluid communication so that pressure in the nozzle cap 61*a* may be restrained from varying when a volume in the nozzle cap 61*a* is reduced due to deformation of the cap unit 61 during the aspiration.

In S204, the ink remaining in the capping unit 61 after the aspiration-purging action may be ejected in post-purging idle aspiration. Specifically, idle aspiration for black, in which the black ink remaining in the nozzle cap 61*a* after the aspiration-purging action for black is ejected, and idle aspiration for colors, in which the colored inks remaining in the nozzle cap 61*b* after the aspiration-purging action for colors is ejected, are conducted continuously.

In the idle-aspiration action for black, the PF and ASF switchable gears 112, 122 are placed in the positions illustrated in FIG. 9E, and the controller rotates the ASF motor 102 in the normal direction so that the crank gear 73 is rotated and the capping unit 61 is lowered, as shown in FIG. 15E. Thereafter, the controller 150 rotates the ASF motor 102 in the reverse direction to rotate the flow-channel member 82 so that the cap-communication port 84*a* and the pump-communication port 84*d* are connected to communicate with each other. In this condition, the controller 150 rotates the PF motor 101 in the normal direction to activate the aspirator pump 63. Thereby, the black ink remaining in the nozzle cap 61*a* may be removed.

In the idle-aspiration action for colors, the PF and ASF switchable gears 112, 122 are placed in the positions illustrated in FIG. 9E, and the controller 150 rotates ASF motor 102 in the normal direction so that the crank gear 73 is rotated and the capping unit 61 is lowered, as shown in FIG. 15F. Thereafter, the controller 150 rotates the ASF motor 102 in the reverse direction to rotate the flow-channel member 82 so that the cap-communication port 84*b* and the pump-communication port 84*d* are connected to communicate with each other. In this condition, the controller 150 rotates the PF motor 101 in the normal direction to activate the aspirator pump 63. Thereby, the colored inks remaining in the nozzle cap 6*ba* may be removed.

In S205, a wiping action, in which the ink adhered to the ink discharging surface 12*a* is wiped by the wiper 59, is conducted. Specifically, the wiper-lifting device 157 is activated to uplift the wiper 59, and the carriage motor 156 is activated to drive the carriage 11 in the scanning direction. Thereby, the ink adhered to the ink discharging surface 12*a* may be wiped off by the wiper 59.

In S206, a flushing action, in which the ink, and the like, that flowed into the nozzles 17 through the wiping action may be removed, is conducted. Specifically, the carriage motor 156 is activated so that the carriage 11 is moved to return to the position, where the ink discharging surface 12*a* faces the capping unit 61, and the inkjet head 12 is driven to discharge the inks at the capping unit 61 through the nozzles 17.

In S207, a post-flushing idle aspiration action, in which the ink collected in the capping unit 61 through the flushing action may be removed, is conducted. The post-flushing idle aspiration action is conducted in the same manner as the post-purging idle aspiration action. After completion of the post-flushing idle aspiration action, the controller 150 rotates the ASF motor 102 in the normal direction to uplift the capping unit 61 and place the printer 1 in the standby state. The maintenance operation ends thereat.

According to the present embodiment, the valve cam 85 in the switcher valve 62 is driven by the ASF motor 102, which is a motor separate from the PF motor 101 to drive the driving rollers 13*a*, 14*a*, 51*a*. In this regard, torque of the PF motor 101 to drive the driving rollers 13*a*, 14*a*, 51*a* may be required to have a certain extent of intensity. Therefore, unlike the configuration of the present embodiment, if the PF motor 101 was configured to drive the valve cam 85 additionally to the driving rollers 13*a*, 14*a*, 51*a*, it might be necessary that driving torque to drive the valve cam 85 is restricted to be lower. When the driving torque for the valve cam 85 is lower, the valve cam 85 may not be rotated when the ink in the switcher valve 62 clots. The driving torque for the valve cam 85 may be increased by increasing a reduction rate in gears that connect the PF motor 101 with the valve cam 85. However, with the increased reduction rate, a rotation velocity of the valve cam 85 may be reduced, and actions to switch the ports in the switcher valve 62 may take longer time.

In this regard, according to the present embodiment described above, the valve cam 85 is driven by the ASF motor 102, which is separated from the PF motor 101. Further, when the valve cam 85 is driven, the ASF switchable gear 122 is engaged with the selector-drivable gear 137*a* but not with the feeder gears 131-133. Therefore, when the valve cam 85 is driven, the driving force from the ASF motor 102 is not transmitted to members or devices (e.g., the feeder rollers 22, 32, 43) other than the valve cam 85. Thus, without increasing the reduction ratio in the gears that connect the ASF motor 102 with the valve cam 85, the torque to drive the valve cam 85 may be increased.

According to the present embodiment described above, while the ASF switchable gear 122 is engaged with the selector-drivable gear 137, and when the ASF motor 102 is rotated in the normal direction, the capping unit 61 is moved vertically by the cap-lifting device 66; and when the ASF motor 102 is rotated in the reverse direction, the flow-channel member 82 rotates in the switcher valve 62. Thus, one of the cap-lifting device 66 and the switcher valve 62 may be selectively driven by switching the rotating directions of the ASF motor 102. Therefore, the cap-lifting device 66 and the ASF motor 102 may be driven by the single motor.

According to the present embodiment described above, when the slider 72 is moved to reciprocate along the conveying direction, the cap retainer 71 and the capping unit 61 are moved vertically by the projection 71*e* of the lifting-lowering member 71 being guided on the bottom 76*a*1 of the groove 76*a*. Meanwhile, the slider 72 is coupled with the crank gear 73; therefore, the slider 71 is moved to reciprocate along the conveying direction as the crank gear 73 rotates in one direction. Thus, by the ASF motor 102 rotating in the normal direction, and the crank gear 73 rotating in one direction, e.g., counterclockwise in FIGS. 6A, 6B, the capping unit 61 may move vertically.

According to the present embodiment described above, when the ASF motor 102 rotates in the normal direction, the planet gear 139*b* engages with the bevel gear 129; and when the ASF motor 102 rotates in the reverse direction, the planet gear 139*b* engages with the valve-drivable gear 134*a*. Therefore, by controlling the rotating direction of the ASF motor 102, the ASF motor 102 may be manipulated to drive one of the cap-lifting device 66 and the switcher valve 62 selectively.

According to the present embodiment described above, in order to seal the ink discharging surface 12*a* by the cap unit 61, the ASF motor 102 is rotated in the normal direction so that the planet gear 139*b* is engaged with the bevel gear 129, and the ASF motor 102 is further rotated in the normal direction to uplift the capping unit 61. While the capping unit 61 seals the ink discharging surface 12*a*, the planet gear 139*b* is engaged with the bevel gear 129. In this condition, when the planet gear 139*b* is subjected to an external force, such as vibration, the planet gear 139*b* may be separated from the crank gear 73 transiently. In such an event, the slider 72 may slide along the conveying direction, and the capping unit 61 may be separated from the ink discharging surface 12*a*. In this regard, according to the present embodiment, the slider 72 has the gear 77*c*, and the gear 77*c* is provided with the oil damper 78 so that the slider 72 may be restrained from sliding excessively. Thereby, when the planet gear 139*a* is separated from the crank gear 73 transiently, the capping unit 61 may be prevented from being separated from the ink discharging surface 12*a*.

According to the present embodiment described above, the conditions of the aspirator pump 63 may be switched between the connected condition and the disconnected condition by controlling the rotating direction of the PF motor 101.

According to the present embodiment described above, when in the standby state, communication between the nozzle caps 61*a*, 61*b* and the aspirator pump 63 is established through the switcher valve 62 while the aspirator pump 63 is in communication with the atmosphere. Therefore, when the flow-channel member 82 adheres to the casing 81, by activating the aspirator pump 63 but without rotating the flow-channel member 82, the switcher valve 62 may be cleaned by the flow of the ink from the inkjet head 12, and the adherence of the flow-channel member 82 to the casing 81 may be resolved.

According to the present embodiment described above, the aspirator pump 63 is driven by the PF motor 101, and the valve cam 85 is driven by the ASF motor 102. In other words, the aspirator pump 63 and the valve cam 85 are driven independently. Therefore, as described above, when the switcher valve 62 is cleaned, the ink may be drawn to the switcher valve 62 while the flow-channel member 82 may be rotated.

In this regard, if, for example, unlike the present embodiment described above, the aspirator pump 63 was in the disconnected condition while the printer 1 is in the standby state, the pressure in the nozzle caps 61*a*, 61*b* may vary. When the pressure in the nozzle caps 61*a*, 61*b* increases, menisci in the ink in the nozzles 17 may collapse. On the other hand, when the pressure in the nozzle caps 61*a*, 61*b* is lowered, the ink may be drawn out of the inkjet head 12 through the nozzles 17 to leak. Meanwhile, according to the present embodiment, the aspirator pump 63 is placed in the connected condition while the printer 1 is in the standby state. Therefore, the pressure in the nozzle caps 61*a*, 61*b* may be maintained steady and prevented from varying.

According to the present embodiment described above, the cap-lifting device 66 and the switcher valve 62 are drivable by the ASF motor 102. Therefore, when the PF motor 101 is rotated in the normal direction to correct skew of the recording sheet P in S105 (FIG. 14), the capping unit 61 is not moved vertically, or the flow-channel member 82 is not rotated. Meanwhile, the aspirator pump 63 is not activated but is switched to the connected condition. Therefore, when the skew of the recording sheet P is being corrected with the capping unit 61 being sealed to the ink discharging surface 12*a*, an undesirable event, such as that one or both of the cap-communication ports 84*a*, 84*b* are connected with the pump-communication port 84*d*, and the ink is drawn out of the inkjet head 12 excessively as the aspirator pump 63 operates, may be prevented.

For example, unlike the present embodiment described above, the cap-lifting device may not necessarily be driven by the ASF motor 102 but may be configured such that the capping unit 61 is uplifted by a force from the carriage 11 that may push the capping unit 61. In this configuration, however, impact of contact or conflict between the capping unit 61 and the ink discharging surface 12*a* when the capping unit 61 is pushed upward may need to be controlled to be smaller. In order to reduce the impact of the conflict, an amount to uplift the capping unit 61 vertically with respect to a distance of the travel in the scanning direction for the carriage 11 should be controlled to be smaller. Therefore, the travel distance for the carriage 11 may need to be longer, and accordingly, a distance for the carriage 11 to travel from the position to face with the capping unit 61 to a position to start printing may be extended. Thus, a time period between input of a print job to print an image and start printing the image on the recording sheet P may be extended.

In contrast, according to the present embodiment described above, the cap-lifting device 66 is driven by the ASF motor 102 to uplift the capping unit 61; therefore, compared to the example mentioned above, the capping unit 61 may be positioned closer to the platen 15, and the time period between input of a print job to print an image and start printing the image on the recording sheet P may be shortened.

According to the printer 1 in the present embodiment, for example, when one or more print jobs containing a large amount of print data is entered, the controller 150 may stop an ongoing printing operation temporarily and process the print data preferentially. In such an event, in order to prevent the ink from drying in the nozzles 17, it may be preferable that the capping unit 61 is fitted to the ink discharging surface 12*a* while the ongoing printing operation is interrupted. However, unlike the printer 1 in the present embodiment, if the driving rollers 13*a*, 14*a* were driven along with the behavior to place the capping unit 61 to fit to the ink discharging surface 12*a*, the recording sheet P may be conveyed by the driving rollers 13*a*, 14*a*, and may be displaced from the stopped position.

In contrast, according to the present embodiment, the cap-lifting device 66 is driven by the ASF motor 102, which is separate from the PF motor 101 that drives the driving rollers 13*a*, 14*a*. Therefore, when the ongoing printing operation is interrupted temporarily, the driving rollers 13*a*, 14*a* are not rotated while the capping unit 61 is moved to fit to the ink discharging surface 12*a*.

According to the present embodiment described above, while the ASF switchable gear 122 is engaged with the selector-drivable gear 137, when the ASF motor 102 is rotated in the normal direction, the capping unit 61 is uplifted; and when the ASF motor 102 is rotated in the reverse direction, the flow-channel member 82 in the switcher valve 62 is rotated. Meanwhile, while the ASF switchable gear 122 is engaged with one of the feeder gears 131-133, when the ASF motor 102 is rotated in the normal or reverse direction, one of the feeder rollers 22, 32, 43 is rotated so that the recording sheet P is fed to the printing unit 2.

For example, unlike the present embodiment described above, a planetary gear system in a comparative exemplary configuration (a) may be provided between one of the feeder gears 131-133 and the ASF input gear 121*a* so that, with the ASF switchable gear 122 being engaged with the one of the feeder gears 131-133, when the ASF motor 102 is rotated in either the normal or reverse direction, the feeder roller corresponding to the one of the feeder gears 131-133 may be rotated. With the ASF switchable gear 122 being engaged with the one of the feeder gears 131-133, when the ASF motor 102 is rotated in either the reverse or normal direction that is opposite from the direction to feed the recording sheet P, the capping unit 61 may be uplifted (comparative exemplary configuration a1); or the flow-channel member 82 in the switcher valve 62 may be rotated (comparative exemplary configuration a2).

After the aspiration-purging action, in order to perform the idle-aspiration action, it may be necessary that the capping unit 61 is lowered, the flow-channel member 82 is rotated, and the switcher valve 62 is switched from the condition illustrated in FIG. 15B to the condition illustrated in FIG. 15C. In this condition, with the comparative configuration (a1), in order to lower the capping unit 61, it may be necessary that the ASF switchable gear 122 is placed to engage with the one of the feeder gears 131-133. Alternatively, with the comparative configuration (a2), in order to lower capping unit 61, it may be necessary that the ASF switchable gear 122 is placed to engage with the selector-drivable gear 137. Further, in order to rotate the flow-channel member 82, it may be necessary that the ASF switchable gear 122 is placed to engage with the one of the feeder gears 131-133.

Following the aspiration-purging action, in order to conduct the idle-aspiration action, in either the comparative configuration (a1) or (a2), it may be necessary that the ASF switchable gear 122 is moved to switch the engaging mate from the one of the feeder gears 131-133 to the selector-drivable gear 137. Meanwhile, in order to switch the engaging mates of the ASF switchable gear 122 without interference of the current engaging mate, it may be necessary to conduct a disengaging action, in which the ASF motor 102 is driven to rotate the ASF switchable gear 122 finely in the normal and reverse directions alternately for a plurality of times to release the ASF switchable gear 122 from the current engaging mate before the ASF switchable gear 122 is moved. Therefore, in the comparative configurations (a1) and (a2), transition between the aspiration-purging action and the idle-aspiration action may take longer time, and a longer period of time may be required for the maintenance operation.

Further, in the comparative configurations (a1) and (a2), transition from the aspiration-purging action to the wiping action may further take longer time. In this regard, the ink in four colors adhered to the ink discharging surface 12*a* during the aspiration-purging may spread over the ink discharging surface 12*a*, and the ink in different colors may be mixed with each other and flow back into the nozzles 17. As a result, in a next printing operation, the contaminated ink may be discharged through the nozzles 17 at the recording sheet P, and quality of the printed image may be lowered. Alternately, in order to remove the contaminated inks through the nozzles 17 sufficiently, it may be necessary that a larger amount of ink is discharged through the nozzles 17 in the flushing action after the wiping action, and the larger amount of ink may be wasted.

Further, another comparative configuration (b) may be considered. Unlike the present embodiment described above, the PF switchable gear 112 may be configured to be switchable between a state, in which the PF switchable gear 112 is engaged with the pump-drivable gear 141*a*, and a state, in which the PF switchable gear 112 is engaged with the valve-drivable gear 134*a*. With the PF switchable gear 112 being engaged with the valve-drivable gear 134*a*, when the PF motor 101 is rotated in either the normal or reverse direction, the flow-channel member 82 may be rotated.

In this comparative configuration (b), during the aspiration purging action, the PF switchable gear 112 may be engaged with the pump-drivable gear 141*a*. After the aspiration-purging action, the PF switchable gear 112 may be switched to engage with the valve-drivable gear 134*a*, and the PF motor 101 may be driven so that the flow-channel member 82 may be rotated, and the state of the switcher valve 62 may be switched from the state illustrated in FIG. 15B to the state illustrated in FIG. 15C. Thereafter, the PF switchable gear 112 may be switched to engage with the pump-drivable gear 141*a*, and the PF motor 101 is rotated in the normal direction to conduct the idle-aspiration action. In this regard, the disengaging action may be required before the PF switchable gear 112 is moved. Therefore, transition between the aspiration-purging action and the idle-aspiration action may take longer time, and a longer period of time may be required for the maintenance.

Further, in the comparative configuration (b), as well as the comparative configurations (a1) and (a2), transition from the aspiration-purging action to the wiping action may further take longer time, and the mixed inks may flow into the nozzles 17 before the wiping action. As a result, in a next printing operation, the contaminated ink may be discharged through the nozzles 17 at the recording sheet P, and quality of the printed image may be lowered. Alternately, in order to remove the contaminated ink through the nozzles 17 sufficiently, it may be necessary that a larger amount of ink is discharged through the nozzles 17 in the flushing action after the wiping action, and the larger amount of ink may be wasted.

Meanwhile, there may be an occasion that the PF or ASF switchable gear 112, 122 may not be switched smoothly, but the switching of the PF or ASF switchable gear 112, 122 may fail. In the case of the comparative configuration (b), when the PF switchable gear 112 fails to engage with the pump-drivable gear 141*a*, the ink may not be aspirated in the aspiration-purging action or the idle-aspiration action. In order to prevent the failure in the aspiration, there may be required to provide a sensor to detect success or failure of the switching motion.

In contrast, according to the present embodiment, while the ASF switchable gear 122 is engaged with the selector-drivable gear 137, the ASF motor 102 may be rotated in the normal direction in order to uplift the capping unit 61, and the ASF motor 102 may be rotated in the reverse direction in order to rotate the flow-channel member 82 in the switcher valve 62. Therefore, while the ASF switchable gear 122 is engaged with the selector-drivable gear 137 during the maintenance, no switching motion to switch the mating gears may be necessary. Thus, according to the present embodiment, lifting and lowering the capping unit 61, rotation of the flow-channel member 82 in the switcher valve 62, and feeding the recording sheets P to the printing unit 2 may be streamlined and conducted more smoothly compared to the comparative configurations (a1), (a2), (b) described above.

In the switcher valve 62, in order to control a rotation angle of the flow-channel member 82 with a certain extent of accuracy, a sensor (not shown) to detect the rotation angle may be provided. With this sensor, the engagements of the PF and ASF switchable gears 112, 122 with the valve-drivable gear 134*a* in the present embodiment, or the comparative configurations (a1), (a2), (b), may be detected based on signals output from the sensor.

Although an example of carrying out the invention has been described, those skilled in the art will appreciate that there are numerous variations and permutations of the liquid discharging device that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims. In the meantime, the terms used to represent the components in the above embodiment may not necessarily agree identically with the terms recited in the appended claims, but the terms used in the above embodiment may merely be regarded as examples of the claimed subject matters.

For example, the printer 1 may not necessarily have three (3) sheet feeders such as the lower cassette feeder 3, the upper cassette feeder 4, and the tray feeder 5, with three (3) feeder gears 131-133, which may switchably engage with the ASF switchable gear 122. For example, the printer may have two (2) or less, or four (4) or more, sheet feeders with two (2) or less, or four (4) or more, feeder gears that may switchably engage with the ASF switchable gear 122.

Specifically, for example, as shown in FIG. 17, a printer 200 may have a single cassette feeder 201. The cassette feeder 201 may be in the same configuration as the upper cassette feeder 4 described above and may be connected with multiple gears including the feeder gear 132 (see FIGS. 9A-9D). The ASF switchable gear 122 may be movable along the shaft 106 so that the ASF switchable gear 122 may be selectively in one of the positions illustrated in FIGS. 9A, 9D, and 9E.

In this modified example, if the PF and ASF switchable gears 112, 122 are placed in the positions illustrated in FIG. 9A, and when the ASF motor 102 rotates in the normal direction, the feeder roller 202 may rotate counterclockwise in FIG. 17 and, in conjunction with the rollers 52, convey the recording sheet P conveyed through the reversing path 53 toward the feeder path 203. On the other hand, when the ASF motor 102 rotates in the reverse direction, the feeder roller 202 may rotate clockwise in FIG. 17 and convey the recording sheet P from the sheet cassette 204 toward the feeder path 203.

According to this modified example, similarly to the previous embodiment described above, the PF switchable gear 112 may be moved to switch engagement and disengagement with the pump-drivable gear 141*a* alone. Meanwhile, the ASF switchable gear 122 may be placed to engage with one of the feeder gear 131 and the selector-drivable gear 137 selectively. Therefore, there may be a risk that the ASF switchable gear 122 is engaged with another gear which should not be engaged with. For example, the capping unit 61 may be lowered for a printing operation, and there may be an attempt to move the ASF switchable gear 122 to the position to engage with the feeder gear 131. However, the ASF switchable gear 122 may be erroneously caught by the selector-drivable gear 137.

In such an occasion, unlike this modified example, if the recording sheet P was to be conveyed from the sheet cassette 204 toward the feeder path 203 when the ASF motor 102 rotates in the normal direction, there may be a risk that the capping unit 61 is uplifted when the ASF motor 102 rotates in the normal direction to feed the recording sheet P from the sheet cassette 204 toward the printing unit 2. In this occasion, when the inkjet head 11 is moved to the position to face with the capping unit 61, the inkjet head 12 or the carriage 11 may collide with the capping unit 61.

In this regard, according to the modified example, the recording sheet P is conveyed from the sheet cassette 203 toward the feeder path 203 when the ASF motor 102 rotates in the reverse direction. Therefore, when the ASF motor 102 is in the reverse rotation to feed the recording sheet P from the sheet cassette 204 to the printing unit 2, even if the ASF switchable gear 122 is erroneously engaged with the selector-drivable gear 137, merely the flow-channel member 82 may rotate in the switcher valve 62, and the capping unit 61 may be prevented from being uplifted.

For another example, the configuration to prevent the slider 72 from excessively sliding along the conveying direction when the planetary gear 139*b* is momentarily separated from the crank gear 73 while the capping unit 61 is fitted to the ink discharging surface 12*a* may not necessarily be limited to the gear 77*c* in the slider 72 and the oil damper 78 but may be replaced with by another configuration. Moreover, the configuration to prevent the slider 72 from excessively sliding along the conveying direction may be omitted.

For another example, in the embodiment described above, the driving force of the ASF motor 102 may be transmitted selectively to one of the bevel gear 129 and the valve-drivable gear 134 through the planet gear 139*b*, which rotates about the axis of the sun gear 139*a*, depending on the rotating direction of the ASF motor 102. However, the driving force of the ASF motor 102 may be transmitted to one of the bevel gear 129 and the valve-drivable gear 134*a* depending on the rotating direction of the ASF motor 102 through a different configuration.

For another example, when the ASF motor 102 rotates with the ASF switchable gear 122 being engaged with the selector-drivable gear 137, the driving force of the ASF motor 102 may not necessarily be transmitted selectively to one of the cap-lifting device 66 and the switcher valve 62 depending on the rotating direction of the ASF motor 102 but may be transmitted selectively to one of the switcher valve 62 and the other drivable devices than the cap-lifting device 66, depending on the rotating direction of the ASF motor 102.

For another example, the slider 72 may not necessarily be coupled to the crank gear 73, of which rotation may be converted to linear movement of the slider 72 along the conveying direction, but the crank gear 73 may be replaced with, for example, another device that may convert the rotation of the ASF motor 102 to linear movement of the slider 72 along the conveying direction.

For another example, the cap-lifting device 66 may not necessarily be configured such that the projection 71*e* of the lifting-lowering member 71 is guided on the bottom 76*a*1 of the groove 76*a* formed in the slider 72, which is movable to reciprocate along the conveying direction, as long as the cap-lifting device may move the capping unit 61 both upward and downward when the ASF motor 102 is rotated in the normal direction.

For another example, transmission and disconnection of the driving force from the PF motor 101 to the aspirator pump 63 may not necessarily be switchable by engagement and disengagement of the PF switchable gear 111 with the pump-drivable gear 141*a*, while the PF switchable gear 112 is engaged with the PF input gear 111, but may be switched by another switchable configuration.

For another example, transmission and disconnection of the driving force from the ASF motor 102 to the feeder rollers 22, 32, 43, the switcher valve 62, and the cap-lifting device 66 may not necessarily be switchable by selective engagement of the ASF switchable gear 112 with one of the feeder gears 131-133 and the selector-drivable gear 137, while the ASF switchable gear 122 is engaged with the ASF input gear 121*a*, but may be switched by another switchable configuration.

For another example, the PF and ASF switchable gears 112, 122 may not necessarily be movable along the scanning direction by being pushed by the carriage 11 but may be moved by a driving force from another source. Further, the PF switchable gear 112 and the ASF switchable gear 122 may not necessarily be movable integrally but may be movable separately by driving forces from different sources.

For another example, the cap-lifting device 66 and the switcher valve 62 may not necessarily be driven by the ASF motor 102 that drives the feeder rollers 22, 32, 43, but may be driven by another motor different from the PF motor 101 or the ASF motor 102, which may, for example, drive a cover of the ejection tray to open and close.

For another example, in order to place the aspirator pump 63 in the disconnected condition to aspirate the fluid, the PF motor 101 may not necessarily be rotated in the normal direction with the PF switchable gear 112 being engaged with the pump-drivable gear 141*a*, or in order to place the aspirator pump 63 in the connected condition, the PF motor 101 may not necessarily be rotated in the reverse direction. The aspirator pump 63 may be switched to the connected condition when the PF motor 101 is rotated in the normal direction and to the disconnected when the PF motor 101 is rotated in the reverse direction to aspirate the fluid.

Further, the aspirator pump 63 may not necessarily be driven by the PF motor 101 that drives the driving rollers 13*a*, 14*a*, 51*a*, but may be driven by another motor different from the PF motor 101 or the ASF motor 102.

Furthermore, the aspirator pump 63 may not necessarily be switchable between the connected condition and the disconnected condition but may be in the disconnected condition at all time. In this configuration, the cap-communication ports 84*a*, 84*b* may be connected with the air-communication port 84*c* in the standby state so that the nozzle caps 61*a*, 61*b* are in fluid communication with the atmosphere. In this configuration, when the printer 1 is in the standby state, the nozzle caps 61*a*, 61*b* are not in fluid communication with the aspirator pump 63; therefore, the valve-cleaning action cannot be performed. In this regard, if dye ink is used in the inkjet head 12 rather than the pigmentary ink, the ink may not easily clot adhesively between the flow-channel member 82 and the casing 81 even after being left for a long period of time. Therefore, absence of the valve-cleaning action may not necessarily cause a problem.

In this regard, if the aspirator pump 63 is configured to be switchable between the connected condition and the disconnected condition, as described in the above embodiment, when the PF motor 101 rotates in the normal direction while the aspirator pump 63 is in the connected condition, the conditions of the aspirator pump 63 is switched from the connected condition to the disconnected condition, and as the PF motor 101 rotates further in the normal direction, the aspirator pump 63 starts aspirating the fluid. However, a rotating amount required for the PF motor 101 to switch the condition of the aspirator pump 63 from the connected condition to the disconnected condition may vary among individual PF motors 101. Therefore, an aspiration amount to aspirate the fluid by the aspirator pump 63 may vary even when the PF motor 101 rotates for a same predetermined amount as different PF motors 101.

Meanwhile, if the aspirator pump 63 is configured to be not switchable between the connected condition and the disconnected condition but to be in the disconnected condition at all times, when the PF motor 101 is activated, the aspirator pump 63 may responsively start aspirating the fluid. Therefore, unlike the embodiment described above, the aspirating amount by the aspirator pump 63 when the PF motor 101 rotates for the predetermined amount may not vary widely, and the aspirating amount by the aspirator pump 63 to aspirate the ink may be controlled more easily.

For another example, the switcher valve 62 may not necessarily have the casing 81, in which the communication ports 84*a*-84*d* are formed, and the flow-channel member 82, which is rotatable in the casing 81 to switch the connection among the communication ports 84*a*-84*d*. For example, the switcher valve may have an outer member, in which communication ports similar to the communication ports 84*a*-

84*d* are formed, and a movable member, which may be movable linearly in the outer member to switch the connection among the communication ports. For another example, the switcher valve may be replaced with another device that does not have the outer member or the movable member.

For another example, the act (S105) of correcting skew in the recording sheet P being fed from the feeder tray 41, by switching the rotating direction of the PF motor 101 when the recording sheet P reaches the conveyer roller 13 and rotating the driving roller 13*a* in the opposite direction from the conveying direction, may be omitted.

For another example, the recording sheet P may not necessarily be conveyed by the rollers including the conveyer rollers 13, 14 but may be conveyed by a different type of conveyer device from the rollers, such as a belt.

For another example, the embodiment described above may not necessarily be applied to an inkjet printer, in which the ink is discharged through the nozzles to print an image on the recording sheet P, but may be similarly applied to a liquid ejecting device that may discharge liquid through nozzles at a discharge-object medium.

What is claimed is:

1. A liquid discharging device, comprising:

a liquid discharging head comprising a plurality of nozzles and a liquid discharging surface, the plurality of nozzles being formed on the liquid discharging surface;

a conveyer configured to convey a medium in a conveying direction, the conveying direction extending at least partly in parallel with the liquid discharging surface;

a nozzle cap configured to move between a contacting position to contact the liquid discharging head and a separated position separated from the liquid discharging head, the nozzle cap being configured to cover the plurality of nozzles when contacting the liquid discharging head;

a pump;

a switcher configured to switch connection and disconnection between the nozzle cap and the pump;

a drivable device;

a first motor connected to the conveyer, the first motor being configured to transmit a driving force thereof to the conveyer to drive the conveyer;

a second motor configured to drive the switcher and the drivable device;

a selector configured to switch transmission destinations for a driving force from the second motor between the switcher and the drivable device to selectively transmit the driving force from the second motor to one of the switcher and the drivable device, the selector switching the transmission destinations depending on a rotating direction of the second motor; and a controller configured to control the second motor to rotate in one of a first direction and a second direction opposite from the first direction, the controller manipulating the selector to switch the transmission destination to the switcher to transmit the driving force from the second motor to the switcher by rotating the second motor in the first direction, and the controller manipulating the selector to switch the transmission destination to the drivable device by rotating the second motor in the second direction, wherein the switcher comprises:

a port-formative member comprising a plurality of communication ports, the plurality of communication ports including a pump-communication port connected with the pump and a cap-communication port connected with the nozzle cap; and a movable member arranged in the port-formative member and configured to be moved in the port-formative member by the driving force from the second motor to switch connection and disconnection among the plurality of communication ports.

2. The liquid discharging device according to claim 1, wherein the selector being in a condition to transmit the driving force from the second motor to the switcher establishes connection for transmission of the driving force from the second motor to the switcher alone.

3. The liquid discharging device according to claim 1, further comprising:

a first transmission switcher configured to establish connection for transmission of the driving force from the first motor to the pump, wherein the pump is configured to conduct one of an aspirating action and a connecting action depending on a rotating direction of the first motor while the connection for the transmission of the driving force from the first motor to the pump is established by the first transmission switcher, the connecting action connecting the nozzle cap with atmosphere;

wherein the controller manipulates the pump to conduct the aspirating action by rotating the first motor in a third direction; and wherein the controller manipulates the pump to conduct the connecting action by rotating the first motor in a fourth direction opposite from the third direction.

4. The liquid discharging device according to claim 3, further comprising:

wherein the first transmission switcher is configured to switch connection and disconnection for the transmission of the driving force from the first motor to the pump while the first transmission switcher connects the first motor with the conveyer for transmitting the driving force, wherein the liquid discharging device further comprises:

a feeder roller configured to be connected with the second motor to be driven by the driving force transmitted from the second motor, the feeder roller being configured to feed the medium to the conveyer; and a second transmission switcher configured to switch transmissivity of the driving force from the second motor at least between a condition, in which connection for transmission of the driving force from the second motor to the feeder roller is established, and another condition, in which connection for transmission of the driving force from the second motor to the selector is established.

5. The liquid discharging device according to claim 4, wherein the controller is configured to drive the conveyer device by rotating the first motor in one of the third direction and the fourth direction;

wherein, while the first transmission switcher establishes the connection for the transmission of the driving force from the first motor to the pump, the controller controls the pump to aspirate the fluid by rotating the first motor in the third direction and controls the pump to connect the nozzle cap with the atmosphere by rotating the first motor in the fourth direction;

wherein, while the second transmission switcher establishes the connection for the transmission of the driving force from the second motor to the feeder roller, the controller controls the feeder roller to feed the medium by rotating the second motor in the first direction; and wherein, while the second transmission switcher establishes the connection for the transmission of the driving force from the second motor to the selector, the controller controls the selector to switch the transmission destination to the switcher to transmit the driving force from the second motor to the switcher by rotating the second motor in the first direction, and the controller controls the selector to switch the transmission destination to the drivable device to transmit the driving force from the second motor to the drivable device by rotating the second motor in the second direction.

6. The liquid discharging device according to claim 4, wherein the conveyer comprises a conveyer roller located in a position upstream from the liquid discharging head with regard to the conveying direction;

wherein the first transmission switcher comprises:

a shaft, to which the conveyer roller is attached, the shaft being connected with the first motor;

a first input gear configured to rotate integrally with the shaft;

a pump-drivable gear configured to transmit the driving force from the first motor to the pump;

a first switchable gear configured to be moved along an axial direction of the shaft between a pump-drivable position, in which the first switchable gear engages with the pump-drivable gear, and a non-drivable position, in which the first switchable gear is disengaged from the pump-drivable gear, the first switchable gear being configured to engage with the first input gear when in the pump-drivable position and when in the non-drivable position; and a first gear-movable device controlled by the controller to move the first switchable gear between the pump-drivable position and the non-drivable position; and wherein the second transmission switcher comprises:

a second input gear connected with the second motor;

a feeder-driving gear configured to transmit the driving force from the second motor to the feeder roller;

a selector-driving gear configured to transmit the driving force from the second motor to the selector;

a second switchable gear configured to be moved along an axial direction of the second input gear between a feeder-drivable position, in which the second switchable gear engages with the feeder-driving gear, and a selector-drivable position, in which the second switchable gear engages with the selector-driving gear, the second switchable gear being configured to engage with the second input gear when in the feeder-drivable position and when in the selector-drivable position; and a second gear-movable device controlled by the controller to move the second switchable gear between the feeder-drivable position and the selector-drivable position.

7. The liquid discharging device according to claim 3, further comprising a head unit including the liquid ejection head, wherein the drivable device comprises a cap-movable device configured to move the nozzle cap in a direction intersecting with the liquid discharging surface, the cap-movable device being configured to move the nozzle cap to contact and to be separated from the head unit.

8. The liquid discharging device according to claim 7, wherein the controller places the liquid discharging device in a standby state by rotating the second motor to manipulate the cap-movable device to move the nozzle cap to contact the head unit and manipulate the switcher to connect the nozzle cap with the pump, and by rotating the first motor in the fourth direction to connect the nozzle cap with the atmosphere;

wherein the controller conducts a cleaning action, in which clot of the liquid in the switcher is dissolvable by rotating the first motor in the third direction to aspirate the fluid and draw the liquid discharged from the liquid discharging head into the switcher, in the liquid discharging device in the standby state; and wherein, during the cleaning action, the controller rotates the second motor to drive the switcher while the pump aspirates the fluid.

9. The liquid discharging device according to claim 7, wherein the cap-movable device comprises:

a slider extending along a predetermined direction in parallel with the liquid discharging surface and configured to reciprocate along the predetermined direction, the slider comprising a guide surface to guide the liquid discharging head thereon, the guide surface being formed to incline with respect to the predetermined direction; and a converter configured to convert rotation of the second motor into linear reciprocation along the predetermined direction and to transmit the linear reciprocation to the slider.

10. The liquid discharging device according to claim 9, wherein the converter comprises a rotary member configured to be transmittable of the driving force transmitted from the second motor, the rotary member being configured to rotate along with the rotation of the second motor while the converter transmits the driving force from the second motor to the slider, the converter being connected with the slider at a position displaced from a rotation axis of the rotary member.

11. The liquid discharging device according to claim 9, wherein the selector comprises a planetary gear system, the planetary gear system comprising:

a sun gear configured to be connected with the second motor to transmit the driving force from the second motor, the sun gear being configured to rotate along with the rotation of the second motor while connection with the second motor is established;

a planet gear configured to be engaged with the sun gear, the planet gear being configured to revolve about the sun gear along with rotation of the sun gear in a direction corresponding to a rotating direction of the sun gear to be connected with selectively one of the cap-movable device and the switcher; and wherein the liquid discharging device further comprises a slippage-restricting member configured to restrain slippage of the slider along the predetermined direction.

12. The liquid discharging device according to claim 1, further comprising:

a head unit including the liquid ejection head;

a first transmission switcher configured to establish connection for transmission of the driving force from the first motor to the pump; and a cap-movable device configured to be driven by the second motor to move the nozzle cap in a direction intersecting with the liquid discharging surface, the cap-movable device being configured to move the nozzle cap to contact and to be separated from the head unit.

13. The liquid discharging device according to claim 12, wherein the cap-movable device moves the nozzle cap via the drivable device.

14. The liquid discharging device according to claim 1, further comprising a feeder roller configured to feed the medium stored in a cassette toward the conveyer, wherein the conveyer comprises a conveyer roller located in a position upstream from the liquid discharging head with regard to the conveying direction, the conveyer roller being configured to nip the medium and convey the medium in the conveying direction; and wherein the controller controls the first motor to rotate in an opposite rotating direction from a rotating direction to convey the medium by the conveyer roller for a predetermined length of time after a leading end of the medium fed by the feeder roller reaches the conveyer roller.

15. A liquid discharging device, comprising:

a liquid discharging head comprising a plurality of nozzles and a liquid discharging surface, the plurality of nozzles being formed on the liquid discharging surface;

a conveyer configured to convey a medium in a conveying direction, the conveying direction extending at least partly in parallel with the liquid discharging surface;

a nozzle cap configured to move between a contacting position to contact the liquid discharging head and a separated position separated from the liquid discharging head, the nozzle cap being configured to cover the plurality of nozzles when contacting the liquid discharging head;

a pump;

a switcher configured to switch connection and disconnection between the nozzle cap and the pump;

a drivable device;

a first motor connected to the conveyer, the first motor being configured to transmit a driving force thereof to the conveyer to drive the conveyer;

a second motor configured to drive the switcher and the drivable device;

a selector configured to switch transmission destinations for a driving force from the second motor between the switcher and the drivable device to selectively transmit the driving force from the second motor to one of the switcher and the drivable device, the selector switching the transmission destinations depending on a rotating direction of the second motor;

a controller configured to control the second motor to rotate in one of a first direction and a second direction opposite from the first direction, the controller manipulating the selector to switch the transmission destination to the switcher to transmit the driving force from the second motor to the switcher by rotating the second motor in the first direction, and the controller manipulating the selector to switch the transmission destination to the drivable device by rotating the second motor in the second direction; and a first transmission switcher configured to establish connection for transmission of the driving force from the first motor to the pump, wherein the pump is configured to conduct one of an aspirating action and a connecting action depending on a rotating direction of the first motor while the connection for the transmission of the driving force from the first motor to the pump is established by the first transmission switcher, the connecting action connecting the nozzle cap with atmosphere;

wherein the controller manipulates the pump to conduct the aspirating action by rotating the first motor in a third direction; and wherein the controller manipulates the pump to conduct the connecting action by rotating the first motor in a fourth direction opposite from the third direction.

16. The liquid discharging device according to claim 15, wherein the selector being in a condition to transmit the driving force from the second motor to the switcher establishes connection for transmission of the driving force from the second motor to the switcher alone.

17. The liquid discharging device according to claim 15, further comprising:

wherein the first transmission switcher is configured to switch connection and disconnection for the transmission of the driving force from the first motor to the pump while the first transmission switcher connects the first motor with the conveyer for transmitting the driving force, wherein the liquid discharging device further comprises:

a feeder roller configured to be connected with the second motor to be driven by the driving force transmitted from the second motor, the feeder roller being configured to feed the medium to the conveyer; and a second transmission switcher configured to switch transmissivity of the driving force from the second motor at least between a condition, in which connection for transmission of the driving force from the second motor to the feeder roller is established, and another condition, in which connection for transmission of the driving force from the second motor to the selector is established.

18. The liquid discharging device according to claim 17, wherein the controller is configured to drive the conveyer device by rotating the first motor in one of the third direction and the fourth direction;

wherein, while the first transmission switcher establishes the connection for the transmission of the driving force from the first motor to the pump, the controller controls the pump to aspirate the fluid by rotating the first motor in the third direction and controls the pump to connect the nozzle cap with the atmosphere by rotating the first motor in the fourth direction;

wherein, while the second transmission switcher establishes the connection for the transmission of the driving force from the second motor to the feeder roller, the controller controls the feeder roller to feed the medium by rotating the second motor in the first direction; and wherein, while the second transmission switcher establishes the connection for the transmission of the driving force from the second motor to the selector, the controller controls the selector to switch the transmission destination to the switcher to transmit the driving force from the second motor to the switcher by rotating the second motor in the first direction, and the controller controls the selector to switch the transmission destination to the drivable device to transmit the driving force from the second motor to the drivable device by rotating the second motor in the second direction.

19. The liquid discharging device according to claim 17, wherein the conveyer comprises a conveyer roller located in a position upstream from the liquid discharging head with regard to the conveying direction;

wherein the first transmission switcher comprises:

a shaft, to which the conveyer roller is attached, the shaft being connected with the first motor;

a first input gear configured to rotate integrally with the shaft;

a pump-drivable gear configured to transmit the driving force from the first motor to the pump;

a first switchable gear configured to be moved along an axial direction of the shaft between a pump-drivable position, in which the first switchable gear engages with the pump-drivable gear, and a non-drivable position, in which the first switchable gear is disengaged from the pump-drivable gear, the first switchable gear being configured to engage with the first input gear when in the pump-drivable position and when in the non-drivable position; and a first gear-movable device controlled by the controller to move the first switchable gear between the pump-drivable position and the non-drivable position; and wherein the second transmission switcher comprises:

a second input gear connected with the second motor;

a feeder-driving gear configured to transmit the driving force from the second motor to the feeder roller;

a selector-driving gear configured to transmit the driving force from the second motor to the selector;

a second switchable gear configured to be moved along an axial direction of the second input gear between a feeder-drivable position, in which the second switchable gear engages with the feeder-driving gear, and a selector-drivable position, in which the second switchable gear engages with the selector-driving gear, the second switchable gear being configured to engage with the second input gear when in the feeder-drivable position and when in the selector-drivable position; and a second gear-movable device controlled by the controller to move the second switchable gear between the feeder-drivable position and the selector-drivable position.

20. The liquid discharging device according to claim 15, further comprising a head unit including the liquid ejection head, wherein the drivable device comprises a cap-movable device configured to move the nozzle cap in a direction intersecting with the liquid discharging surface, the cap-movable device being configured to move the nozzle cap to contact and to be separated from the head unit.

21. The liquid discharging device according to claim 20, wherein the controller places the liquid discharging device in a standby state by rotating the second motor to manipulate the cap-movable device to move the nozzle cap to contact the head unit and manipulate the switcher to connect the nozzle cap with the pump, and by rotating the first motor in the fourth direction to connect the nozzle cap with the atmosphere;

wherein the controller conducts a cleaning action, in which clot of the liquid in the switcher is dissolvable by rotating the first motor in the third direction to aspirate the fluid and draw the liquid discharged from the liquid discharging head into the switcher, in the liquid discharging device in the standby state; and wherein, during the cleaning action, the controller rotates the second motor to drive the switcher while the pump aspirates the fluid.

22. The liquid discharging device according to claim 20, wherein the cap-movable device comprises:

a slider extending along a predetermined direction in parallel with the liquid discharging surface and configured to reciprocate along the predetermined direction, the slider comprising a guide surface to guide the liquid discharging head thereon, the guide surface being formed to incline with respect to the predetermined direction; and a converter configured to convert rotation of the second motor into linear reciprocation along the predetermined direction and to transmit the linear reciprocation to the slider.

23. The liquid discharging device according to claim 22, wherein the converter comprises a rotary member configured to be transmittable of the driving force transmitted from the second motor, the rotary member being configured to rotate along with the rotation of the second motor while the converter transmits the driving force from the second motor to the slider, the converter being connected with the slider at a position displaced from a rotation axis of the rotary member.

24. The liquid discharging device according to claim 22, wherein the selector comprises a planetary gear system, the planetary gear system comprising:

a sun gear configured to be connected with the second motor to transmit the driving force from the second motor, the sun gear being configured to rotate along with the rotation of the second motor while connection with the second motor is established;

a planet gear configured to be engaged with the sun gear, the planet gear being configured to revolve about the sun gear along with rotation of the sun gear in a direction corresponding to a rotating direction of the sun gear to be connected with selectively one of the cap-movable device and the switcher; and wherein the liquid discharging device further comprises a slippage-restricting member configured to restrain slippage of the slider along the predetermined direction.

25. The liquid discharging device according to claim 15, further comprising:

a head unit including the liquid ejection head;

a first transmission switcher configured to establish connection for transmission of the driving force from the first motor to the pump; and a cap-movable device configured to be driven by the second motor to move the nozzle cap in a direction intersecting with the liquid discharging surface, the cap-movable device being configured to move the nozzle cap to contact and to be separated from the head unit.

26. The liquid discharging device according to claim 25, wherein the cap-movable device moves the nozzle cap via the drivable device.

27. The liquid discharging device according to claim 15, further comprising a feeder roller configured to feed the medium stored in a cassette toward the conveyer, wherein the conveyer comprises a conveyer roller located in a position upstream from the liquid discharging head with regard to the conveying direction, the conveyer roller being configured to nip the medium and convey the medium in the conveying direction; and wherein the controller controls the first motor to rotate in an opposite rotating direction from a rotating direction to convey the medium by the conveyer roller for a predetermined length of time after a leading end of the medium fed by the feeder roller reaches the conveyer roller.

28. A liquid discharging device, comprising:

a liquid discharging head comprising a plurality of nozzles and a liquid discharging surface, the plurality of nozzles being formed on the liquid discharging surface;

a conveyer configured to convey a medium in a conveying direction, the conveying direction extending at least partly in parallel with the liquid discharging surface;

a nozzle cap configured to move between a contacting position to contact the liquid discharging head and a separated position separated from the liquid discharging head, the nozzle cap being configured to cover the plurality of nozzles when contacting the liquid discharging head;

a pump;

a valve connected with the nozzle cap through a first tube and with the pump through a second tube, the valve being configured to switch connection and disconnection between the nozzle cap and the pump;

a drivable device;

a first motor connected to the conveyer, the first motor being configured to transmit a driving force thereof to the conveyer to drive the conveyer;

a second motor configured to drive the valve and the drivable device;

a selector configured to switch transmission destinations for a driving force from the second motor between the valve and the drivable device to selectively transmit the driving force from the second motor to one of the valve and the drivable device, the selector switching the transmission destinations depending on a rotating direction of the second motor; and a controller configured to control the second motor to rotate in one of a first direction and a second direction opposite from the first direction, the controller manipulating the selector to switch the transmission destination to the valve to transmit the driving force from the second motor to the valve by rotating the second motor in the first direction, and the controller manipulating the selector to switch the transmission destination to the drivable device by rotating the second motor in the second direction.

29. The liquid discharging device according to claim 28, wherein the selector comprises a planetary gear system, the planetary gear system comprising:

a sun gear configured to be connected with the second motor to transmit the driving force from the second motor, the sun gear being configured to rotate along with the rotation of the second motor while connection with the second motor is established;

a planet gear configured to be engaged with the sun gear, the planet gear being configured to revolve about the sun gear along with rotation of the sun gear in a direction corresponding to a rotating direction of the sun gear to be connected with selectively one of the valve and the drivable device.

* * * * *